US011653802B2

(12) United States Patent
Iwakami et al.

(10) Patent No.: US 11,653,802 B2
(45) Date of Patent: May 23, 2023

(54) CLEANER AND METHOD FOR SETTING CLEANER

(71) Applicant: MAKITA CORPORATION, Anjo (JP)

(72) Inventors: Junichi Iwakami, Anjo (JP); Yuta Kawai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/408,743

(22) Filed: Aug. 23, 2021

(65) Prior Publication Data

US 2022/0160195 A1 May 26, 2022

(30) Foreign Application Priority Data

Nov. 20, 2020 (JP) ..... JP2020-193471

(51) Int. Cl.

| | |
|---|---|
| ***A47L 9/00*** | (2006.01) |
| ***A47L 5/24*** | (2006.01) |
| ***F04D 29/66*** | (2006.01) |
| ***A47L 9/02*** | (2006.01) |
| ***A47L 5/22*** | (2006.01) |

(52) U.S. Cl.

CPC ..... *A47L 9/0081* (2013.01); *A47L 5/22* (2013.01); *A47L 5/24* (2013.01); *A47L 9/02* (2013.01); *F04D 29/66* (2013.01); *F04D 29/661* (2013.01); *F04D 29/663* (2013.01); *F04D 29/668* (2013.01)

(58) Field of Classification Search

CPC ..... F04D 29/66; F04D 29/661; F04D 29/663; F04D 29/668; A47L 5/22

See application file for complete search history.

(56) References Cited

U.S. PATENT DOCUMENTS 3,334,370 A * 8/1967 Boyd ..... A47L 5/24 15/327.2
2005/0220614 A1* 10/2005 Tsuzuki ..... F04D 29/161 415/206
2018/0252238 A1 9/2018 Hwang et al.

FOREIGN PATENT DOCUMENTS

JP 6686131 B2 4/2020

OTHER PUBLICATIONS

Characteristics of Aerodynamic and Noise for Tubular Centrifugal Fan by Futigami et al. The reference was made of record by Applicant on Oct. 21, 2022. However, it was not listed in an IDS. Thus it is included here to show it was considered. (Year: 1998).*

* cited by examiner

*Primary Examiner* — Woody A Lee, Jr.
*Assistant Examiner* — Brian O Peters
(74) *Attorney, Agent, or Firm* — Oliff PLC

(57) ABSTRACT

A cleaner reduces noise. The cleaner includes a motor, a fan including a number Z of blades and rotatable at a rotational speed N, indicating revolutions per minute, about a rotation axis by the motor, a cover having an inlet located frontward from the fan, and a number V of ribs located in the inlet. The ribs extend in a radial direction from the rotation axis and are arranged in a circumferential direction about the rotation axis. The fan is rotatable to produce noise having a frequency $f_{NZ}$ of 20,000 Hz or higher, and $f_{NZ}=(m-k\times V)\times N/60$ and $m=n\times Z+k\times V$, where n is an order, m is an integer, and k is an integer.

6 Claims, 22 Drawing Sheets

FIG. 19

| m \ σ | 0 | 1/4 | 1/2 | 3/4 |
|---|---|---|---|---|
| 1 | 1.18 | 1.64 | 1.36 | 1.15 |
| 2 | 1.53 | 1.50 | 1.34 | 1.15 |
| 4 | 1.33 | 1.33 | 1.29 | 1.14 |
| 8 | 1.21 | 1.21 | 1.20 | 1.14 |
| 16 | 1.13 | 1.13 | 1.13 | 1.12 |
| 32 | 1.08 | 1.08 | 1.08 | 1.08 |

FIG. 20

(n = 1)

| k | −5 | −4 | −3 | −2 | −1 | 0 | 1 | 2 | 3 | 4 | 5 |
|---|---|---|---|---|---|---|---|---|---|---|---|
| m | −22 | −17 | −12 | −7 | −2 | 3 | 8 | 13 | 18 | 23 | 28 |
| $f_{NZ}$ | 30 | 30 | 30 | 30 | 30 | 30 | 30 | 30 | 30 | 30 | 30 |

CLEANER AND METHOD FOR SETTING CLEANER

CROSS-REFERENCE TO RELATED APPLICATIONS

This application claims the benefit of priority to Japanese Patent Application No. 2020-193471, filed on Nov. 20, 2020, the entire contents of which are hereby incorporated by reference.

BACKGROUND

1. Technical Field

The present disclosure relates to a cleaner and a method for setting the cleaner.

2. Description of the Background

A known cleaner includes a suction unit as described in Japanese Patent No. 6686131.

BRIEF SUMMARY

The cleaner produces noise that may cause discomfort to the user and other persons nearby.

One or more aspects of the present disclosure are directed to a cleaner that reduces noise.

A first aspect of the present disclosure provides a cleaner, including:

a motor;

a fan including a number Z of blades, the fan being rotatable at a rotational speed N about a rotation axis by the motor, the rotational speed N indicating revolutions per minute;

a cover having an inlet located frontward from the fan; and a number V of ribs located in the inlet, the ribs extending in a radial direction from the rotation axis and arranged in a circumferential direction about the rotation axis, wherein the fan is rotatable to produce noise having a frequency $f_{NZ}$ of 20,000 Hz or higher, and $f_{NZ}=(m-k\times V)\times N/60$ and $m=n\times z+k\times V$, where n is an order, m is an integer, and k is an integer.

A second aspect of the present disclosure provides a method for setting a cleaner, the method including:

determining a number Z of blades included in a fan rotatable about a rotation axis by a motor);

determining a number V of ribs located in an inlet located frontward from the fan, the ribs extending in a radial direction from the rotation axis; and determining the number Z of blades, the number V of ribs, and a rotational speed N of the fan indicating revolutions per minute to cause noise produced by rotation of the fan to have a frequency $f_{NZ}$ of 20,000 Hz or higher, wherein $f_{NZ}=(m-k\times V)\times N/60$ and $m=n\times z+k\times V$, where n is an order, m is an integer, and k is an integer.

The cleaner according to the above aspects of the present disclosure reduces noise.

BRIEF DESCRIPTION OF DRAWINGS

FIG. 19 is an example table showing the characteristic Mach number in the embodiment.

FIG. 20 is a table describing a method for calculating the frequency of noise in the embodiment.

DETAILED DESCRIPTION

Although one or more embodiments of the present disclosure will now be described with reference to the drawings, the present disclosure is not limited to the present embodiments. The components in the embodiments described below may be combined as appropriate. One or more components may be eliminated.

In the embodiments, the positional relationships between the components will be described using the directional terms such as front and rear (or forward and backward), right and left (or lateral), and up and down (or vertical). The terms indicate relative positions or directions with respect to the center of a cleaner 1.

The cleaner 1 includes a motor 14. The motor 14 includes a rotor rotatable about a rotation axis AX. A radial direction from the rotation axis AX is referred to as a radial direction or radially for convenience in the embodiments. A direction about the rotation axis AX is referred to as a circumferential direction (or circumferentially) or a rotation direction for convenience. A direction parallel to the rotation axis AX is referred to as an axial direction or axially for convenience.

A position nearer the rotation axis AX in the radial direction, or a radial direction toward the rotation axis AX, is referred to as radially inward for convenience. A position farther from the rotation axis AX in the radial direction, or a radial direction away from the rotation axis AX, is referred to as radially outward for convenience. A position in one circumferential direction (first direction), or one circumferential direction (first direction), is referred to as a first circumferential direction for convenience. A position in the other circumferential direction (second direction), or the other circumferential direction (second direction), is referred to as a second circumferential direction for convenience. A position in one axial direction (first direction), or one axial direction (first direction), is referred to as a first axial direction for convenience. A position in the other axial direction (second direction), or the other axial direction (second direction), is referred to as a second axial direction for convenience.

In the embodiments, the rotation axis AX extends in a front-rear direction. The first axial direction is the front direction. The second axial direction is the rear direction.

Overview of Cleaner

Figure 1:
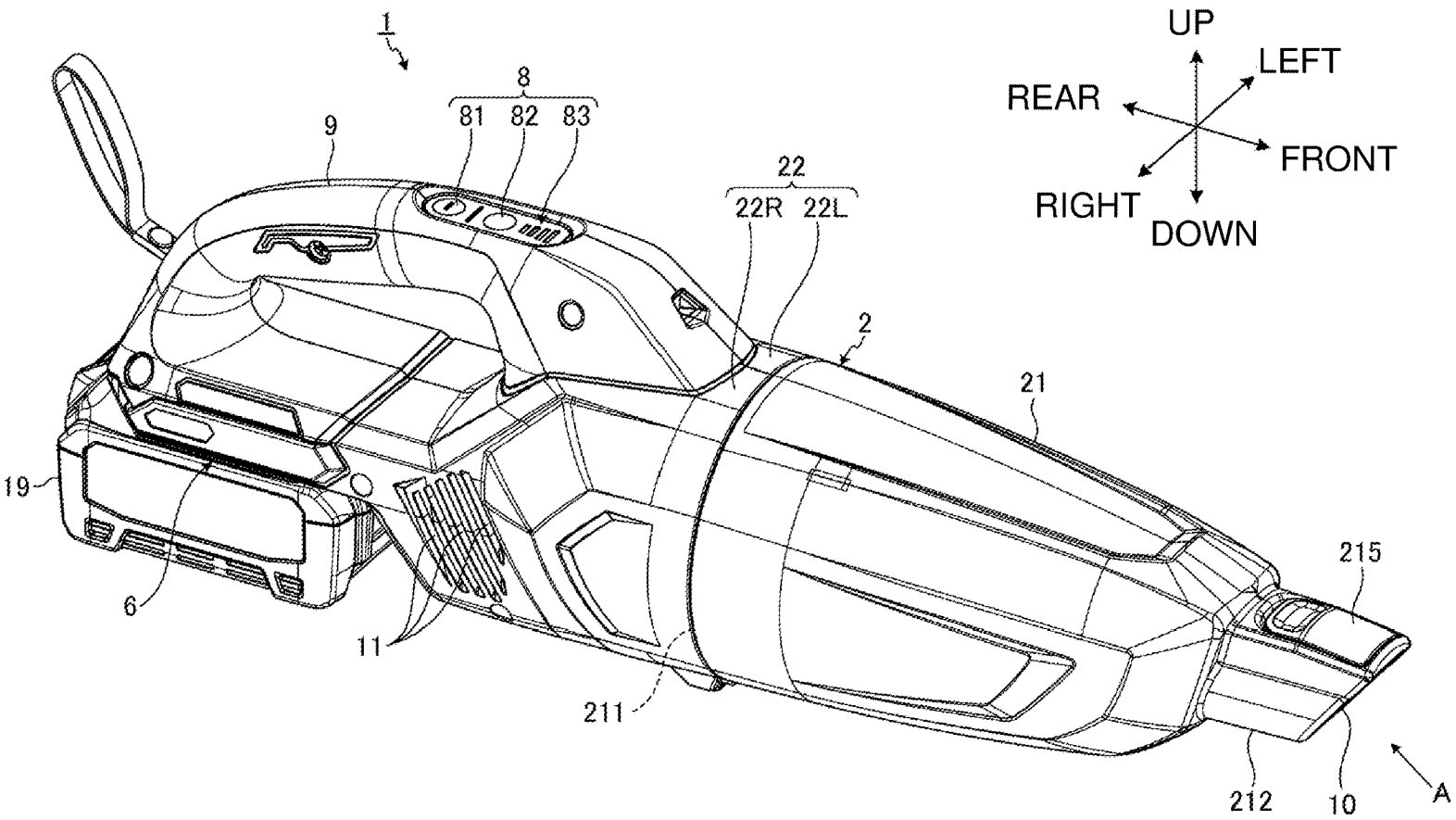
FIG. 1 is a perspective view of a cleaner according to an embodiment.
Figure 2:
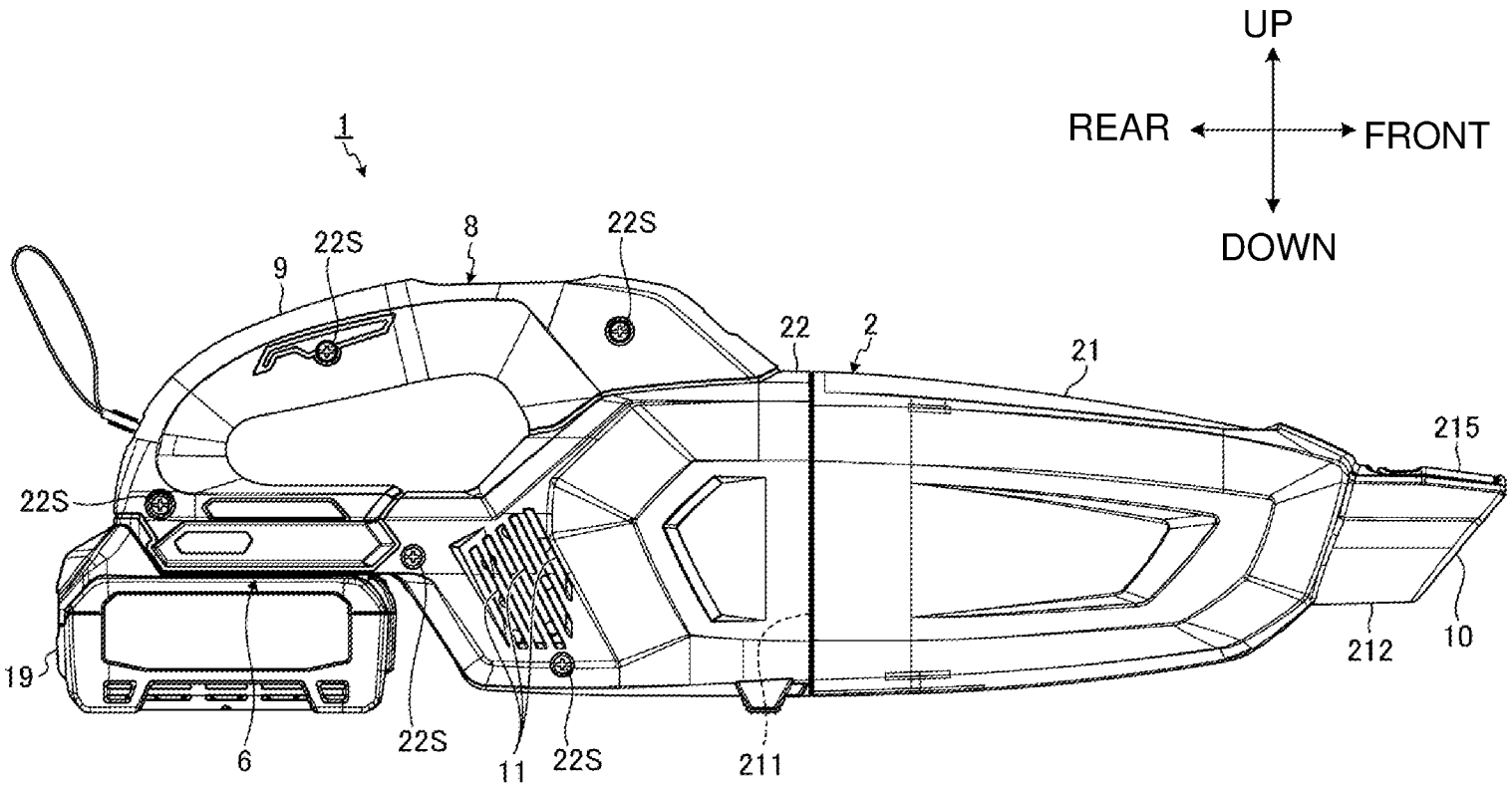
FIG. 2 is a side view of the cleaner according to the embodiment.
Figure 3:
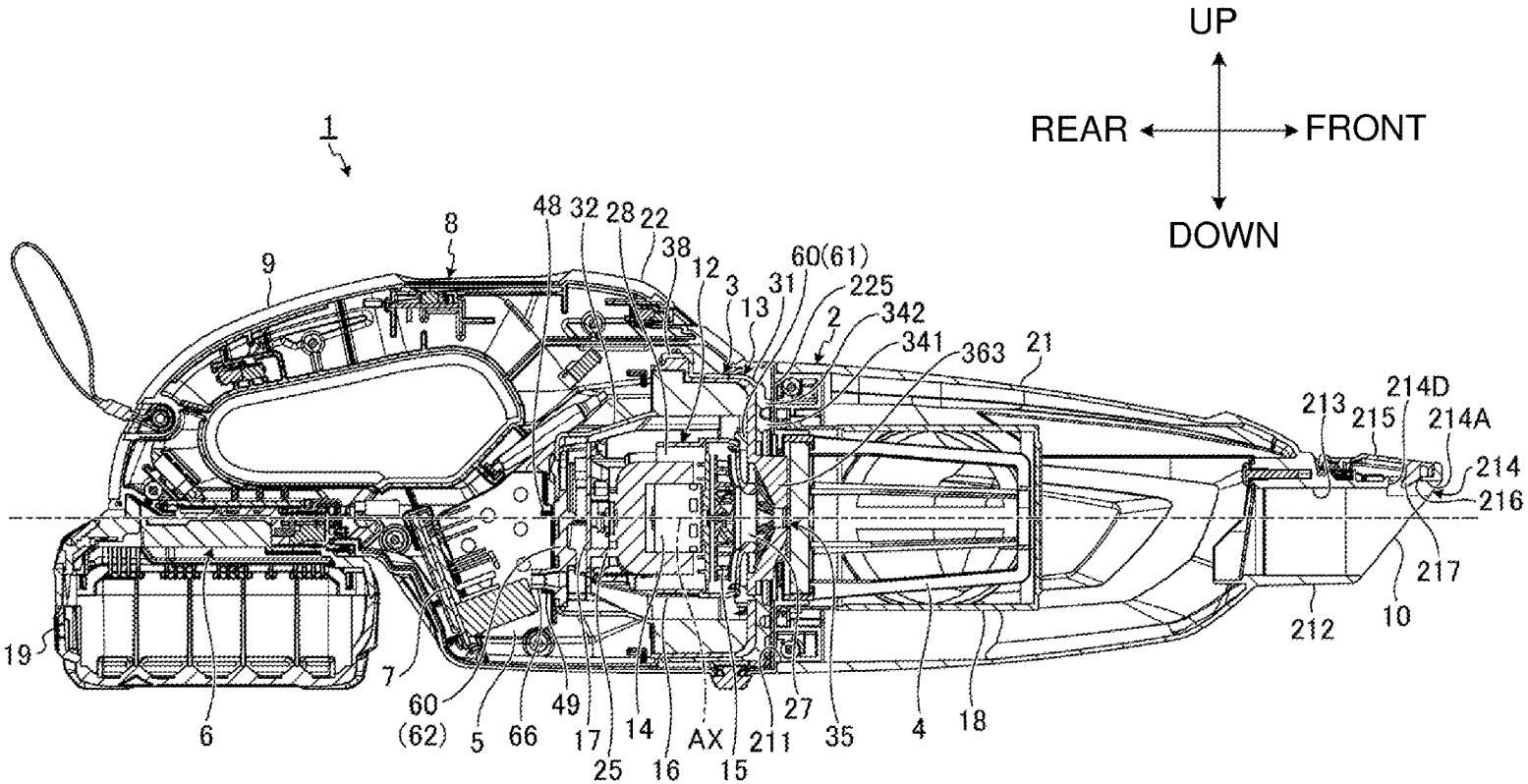
FIG. 3 is a cross-sectional view of the cleaner according to the embodiment.

FIG. 1 is a perspective view of the cleaner 1 according to an embodiment. FIG. 2 is a side view of the cleaner 1 according to the embodiment. FIG. 3 is a cross-sectional view of the cleaner 1 according to the embodiment.

The cleaner 1 includes a housing 2, a suction unit 3, a filter holder 4, sound absorbers 5, a battery mount 6, a controller 7, and an interface unit 8.

The housing 2 includes a handle 9 gripped by a user of the cleaner 1. The cleaner 1 is a handheld cleaner including the handle 9 that is gripped by the user for cleaning.

The housing 2 accommodates the suction unit 3, the filter holder 4, the sound absorbers 5, and the controller 7. The housing 2 has a suction port 10 on its front end, and exhaust ports 11 on both its rear right and its rear left. The suction port 10 connects the outside and the inside of the housing 2. The exhaust ports 11 connect the inside and the outside of the housing 2.

The suction unit 3 generates a suction force through the suction port 10. The suction unit 3 includes a motor assembly 12 and a cover 13. The motor assembly 12 includes the motor 14, a fan 15, a motor case 16, and a control board 17. The motor 14 generates a rotational force for rotating the fan 15. The fan 15 rotates with the rotational force generated by the motor 14. The motor case 16 accommodates the motor 14 and the fan 15. The control board 17 outputs control signals for controlling the motor 14. The control board 17 includes, for example, field-effect transistors (FETs). The cover 13 surrounds and accommodates the motor assembly 12.

The motor 14 runs and rotates the fan 15, which then generates a suction force through the suction port 10. Air outside the housing 2 flows through the suction port 10 into the housing 2. Air inside the housing 2 flows through the exhaust ports 11 out of the housing 2.

The filter holder 4 includes multiple linear members to hold a filter 18. The filter 18 surrounds the filter holder 4 to collect dust from air flowing into the housing 2 through the suction port 10. The filter holder 4 and the filter 18 are between the suction port 10 and the suction unit 3 inside the housing 2.

The sound absorbers 5 are located inside the housing 2 and face the exhaust ports 11. The sound absorbers 5 are formed from a porous material with open-cell foam. The sound absorbers 5 absorb sound traveling through air to reduce noise. The cleaner 1 produces, for example, noise from airflow and noise (NZ) resulting from rotation of the fan 15.

The battery mount 6 is located below the housing 2 at the rear. The battery mount 6 receives a battery pack 19 in a detachable manner.

The battery pack 19 serves as a power supply for the cleaner 1. The battery pack 19 is attached to the battery mount 6 and supplies power to the cleaner 1. The motor 14 runs on power supplied from the battery pack 19. The controller 7 operates on power supplied from the battery pack 19. The battery pack 19 is a general-purpose battery for powering various electrical instruments. The battery pack 19 is usable for powering power tools or other electrical instruments. The battery pack 19 is usable for powering cleaners other than the cleaner 1 according to the embodiment. The battery pack 19 is a rechargeable battery such as a lithium-ion battery. The battery mount 6 has a structure similar to the structure of a battery mount in a power tool.

The user of the cleaner 1 attaches and detaches the battery pack 19 to and from the battery mount 6. The battery mount 6 includes a guide and a mount terminal. The battery pack 19 includes a battery terminal. The guide on the battery mount 6 guides the battery pack 19. The mount terminal on the battery mount 6 is connectable to the battery terminal on the battery pack 19. The user places the battery pack 19 from the rear and moves the battery pack 19 along the guide to attach the battery pack 19 to the battery mount 6. This electrically connects the battery terminal on the battery pack 19 and the mount terminal on the battery mount 6. The battery pack 19 includes a release button. The user of the cleaner 1 operates the release button on the battery pack 19 to move the battery pack 19 backward to remove the battery pack 19 from the battery mount 6.

The controller 7 controls electronic devices in the cleaner 1. The controller 7 controls the motor 14 with the control board 17. The controller 7 controls the drive current to be supplied from the battery pack 19 to the motor 14. The controller 7 and the control board 17 are connected to each other with a cable (not shown). The cable is used to, for example, supply power from the battery pack 19 to the motor 14 as a power line and provide control signals to the control board 17 as a signal line. The controller 7 includes a board incorporating multiple electronic components. Examples of the electronic components on the board include a processor such as a central processing unit (CPU), a nonvolatile memory such as a read-only memory (ROM) or a storage, a volatile memory such as a random-access memory (RAM), and a resistor.

The interface unit 8 is located on the handle 9. The interface unit 8 includes a drive button 81, a mode switch button 82, and an indicator 83. The user gripping the handle 9 can push the drive button 81 and the mode switch button 82.

The motor 14 that is stopped starts running in response to the drive button 81 being pushed. This causes the fan 15 to rotate to generate a suction force through the suction port 10. The suction force causes air outside the housing 2 to be sucked through the suction port 10 together with dust. The air sucked through the suction port 10 flows into the housing 2.

After flowing into the housing 2, the air flows through the filter 18, which collects dust in the air. The air flows through the filter 18 and the suction unit 3 and is then discharged out of the housing 2 through the exhaust ports 11.

The rotational speed of the motor 14 is adjusted in four steps in response to the mode switch button 82 being pushed while the motor 14 is running. In response to a push on the mode switch button 82, the running motor 14 switches from a first rotational speed to a second rotational speed. In response to another push on the mode switch button 82, the motor 14 switches from the second rotational speed to a third rotational speed. In response to still another push on the mode switch button 82, the motor 14 switches from the third rotational speed to a fourth rotational speed. In response to still another push on the mode switch button 82, the motor 14 switches back to the first rotational speed. As the motor 14 changes its rotational speed, the suction force through the suction port 10 changes accordingly. The running motor 14 stops in response to the drive button 81 being pushed.

The indicator 83 includes four light emitters. The light emitters are, for example, light-emitting diodes (LEDs). With the motor 14 running at the first rotational speed, one of the light emitters is on. With the motor 14 running at the second rotational speed, two of the light emitters are on. With the motor 14 running at the third rotational speed, three of the light emitters are on. With the motor 14 running at the fourth rotational speed, the four light emitters are on. With the motor 14 stopped, the four light emitters are off.

Housing

The housing 2 includes a front housing 21 and a rear housing 22. The front housing 21 has an opening 211 at the rear to receive the front of the rear housing 22. This allows the front housing 21 and the rear housing 22 to be connected together in a detachable manner.

The front housing 21 includes a connection pipe 212 at the front. The connection pipe 212 has the suction port 10 at the front end. The front housing 21 accommodates the filter holder 4 and the filter 18 in the internal space.

The rear housing 22 includes the handle 9. The battery mount 6 is located below the rear housing 22. The rear housing 22 includes a left housing 22L and a right housing 22R. The left housing 22L is located on the left of the right housing 22R. The left housing 22L and the right housing 22R are fastened together with multiple screws 22S. The left housing 22L and the right housing 22R each have the exhaust ports 11. The rear housing 22 accommodates the suction unit 3, the sound absorbers 5, and the controller 7 in the internal space.

Figure 4:
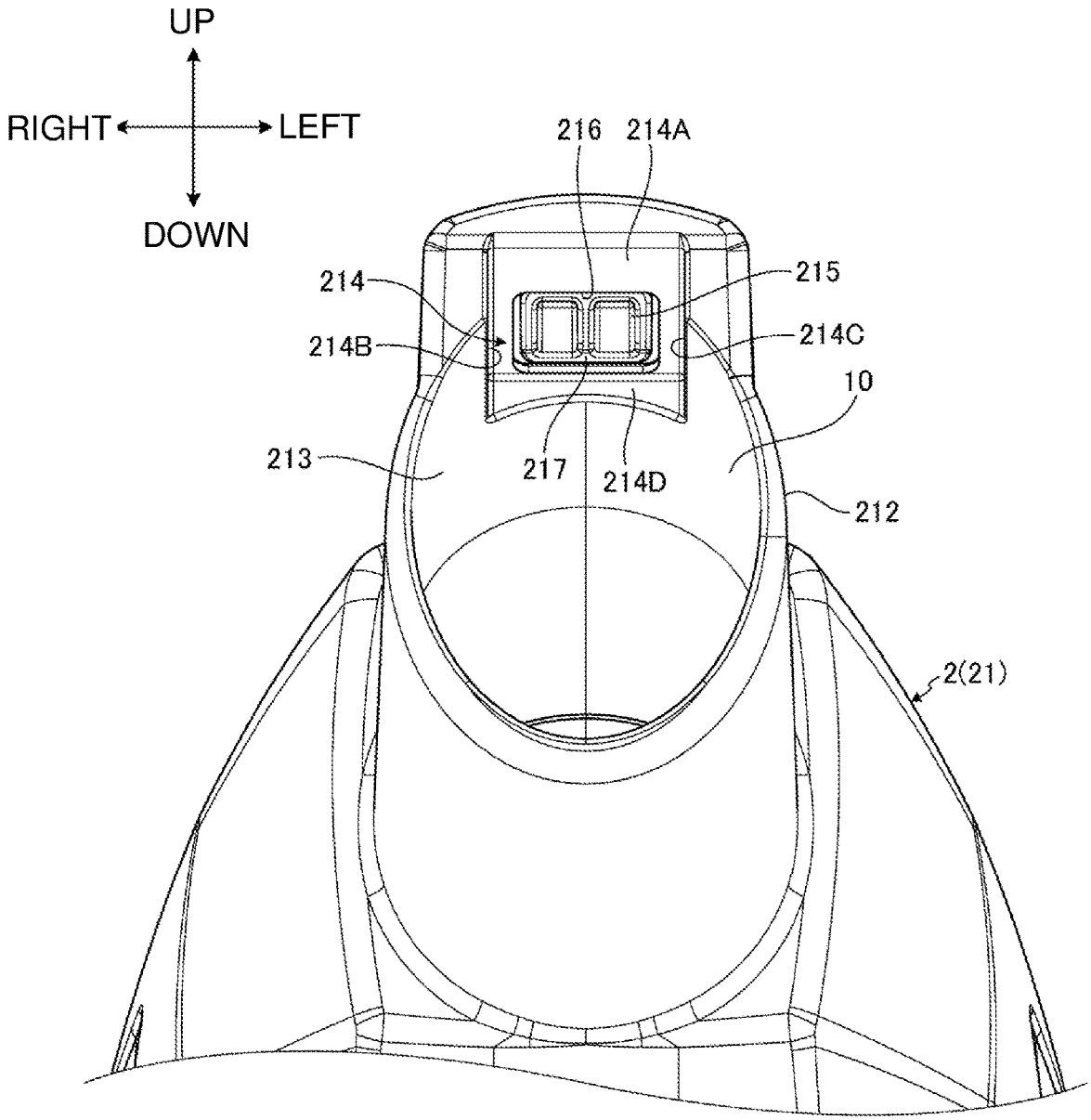
FIG. 4 is a view of a connection pipe in the embodiment.

FIG. 4 is a view of the connection pipe 212 in the embodiment. FIG. 4 shows the housing 2 as viewed in direction A in FIG. 1.

As shown in FIGS. 3 and 4, the connection pipe 212 has an inner surface 213 defining a flow path. The inner surface 213 surrounds the rotation axis AX. The inner surface 213 extends substantially parallel to the rotation axis AX.

The connection pipe 212 has a recess 214. The recess 214 is recessed rearward from the upper front end of the connection pipe 212. The recess 214 has an inner surface including a first face 214A, a second face 214B, a third face 214C, and a fourth face 214D.

The first face 214A, the second face 214B, and the third face 214C extend substantially parallel to the rotation axis AX. The fourth face 214D is substantially orthogonal to an axis parallel to the rotation axis AX. The first face 214A faces downward. The second face 214B faces leftward. The third face 214C faces rightward. The fourth face 214D faces frontward. The second face 214B has an upper end connected to the right end of the first face 214A. The third face 214C has an upper end connected to the left end of the first face 214A. The fourth face 214D has an upper end connected to the rear end of the first face 214A. The second face 214B, the third face 214C, and the fourth face 214D each have a lower end connected to the inner surface 213. The lower end of the second face 214B and the inner surface 213 define a corner. The lower end of the third face 214C and the inner surface 213 define a corner. The lower end of the fourth face 214D and the inner surface 213 define a corner.

The suction port 10 receives a basal end of a suction pipe (not shown). The suction pipe is detachable from the connection pipe 212. The connection pipe 212 includes a lock 215. The lock 215 allows the suction pipe to be fastened to the connection pipe 212.

The lock 215 is at least partly located in an opening 216 in the first face 214A. The lock 215 includes a hook 217. The hook 217 faces the flow path in the connection pipe 212. The hook 217 protrudes toward the flow path in the connection pipe 212. The lock 215 is pivotably supported on the connection pipe 212 to allow the hook 217 to be switchable between the positions where the hook 217 protrudes and does not protrude from the first face 214A. A spring (not shown) is located between the connection pipe 212 and the lock 215. The spring applies an elastic force to the lock 215 to cause the hook 217 to protrude from the first face 214A. The suction pipe has a recess. The hook 217 is hooked in the recess on the suction pipe to fasten the suction pipe to the connection pipe 212. The lock 215 is unlocked to release the suction pipe from the connection pipe 212.

The hook 217 is located frontward from the fourth face 214D. The hook 217 protruding from the first face 214A faces the fourth face 214D.

The suction port 10 being blocked may cause surging depending on the structure of the fan 15. Surging refers to a phenomenon in which the suction port 10 is at least partly blocked and decreases airflow through the suction port 10, producing abnormal noise. As described above, the lock 215 is at least partly located in the opening 216 in the connection pipe 212. The connection pipe 212 and the rear of the lock 215 define a first gap. The connection pipe 212 and the rear of the hook 217 also define a second gap. When the suction port 10 is blocked, air flows between the connection pipe 212 and the lock 215 through the first gap and into the flow path in the connection pipe 212 through the second gap. This structure reduces surging. The suction pipe is received in the connection pipe 212 and fastened with the hook 217 to block the second gap. This avoids leakage of air through the second gap to generate an adequate suction force.

Sound Absorber

Figure 5:
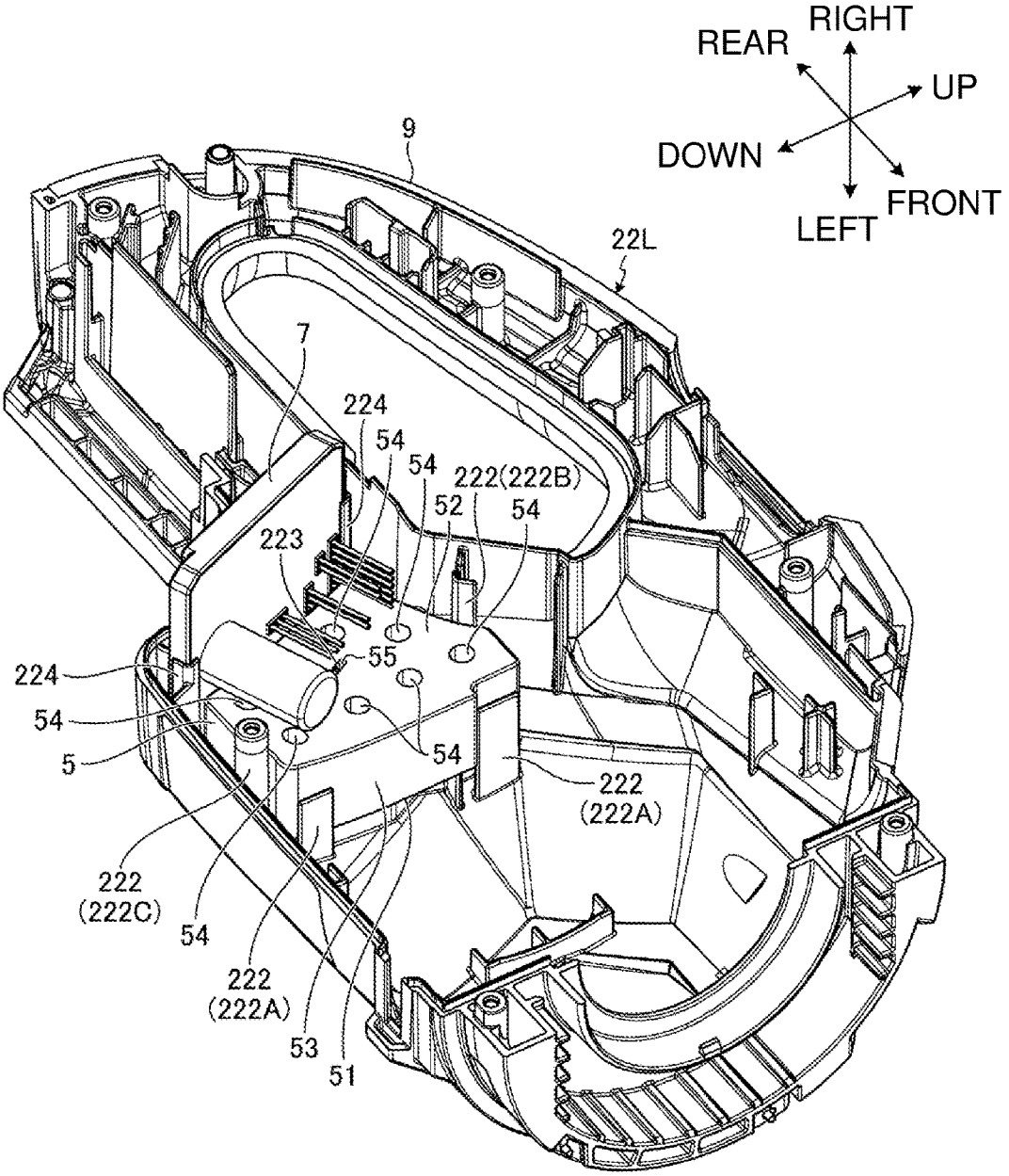
FIG. 5 is a perspective view of a left housing, a sound absorber, and a controller in the embodiment.
Figure 6:
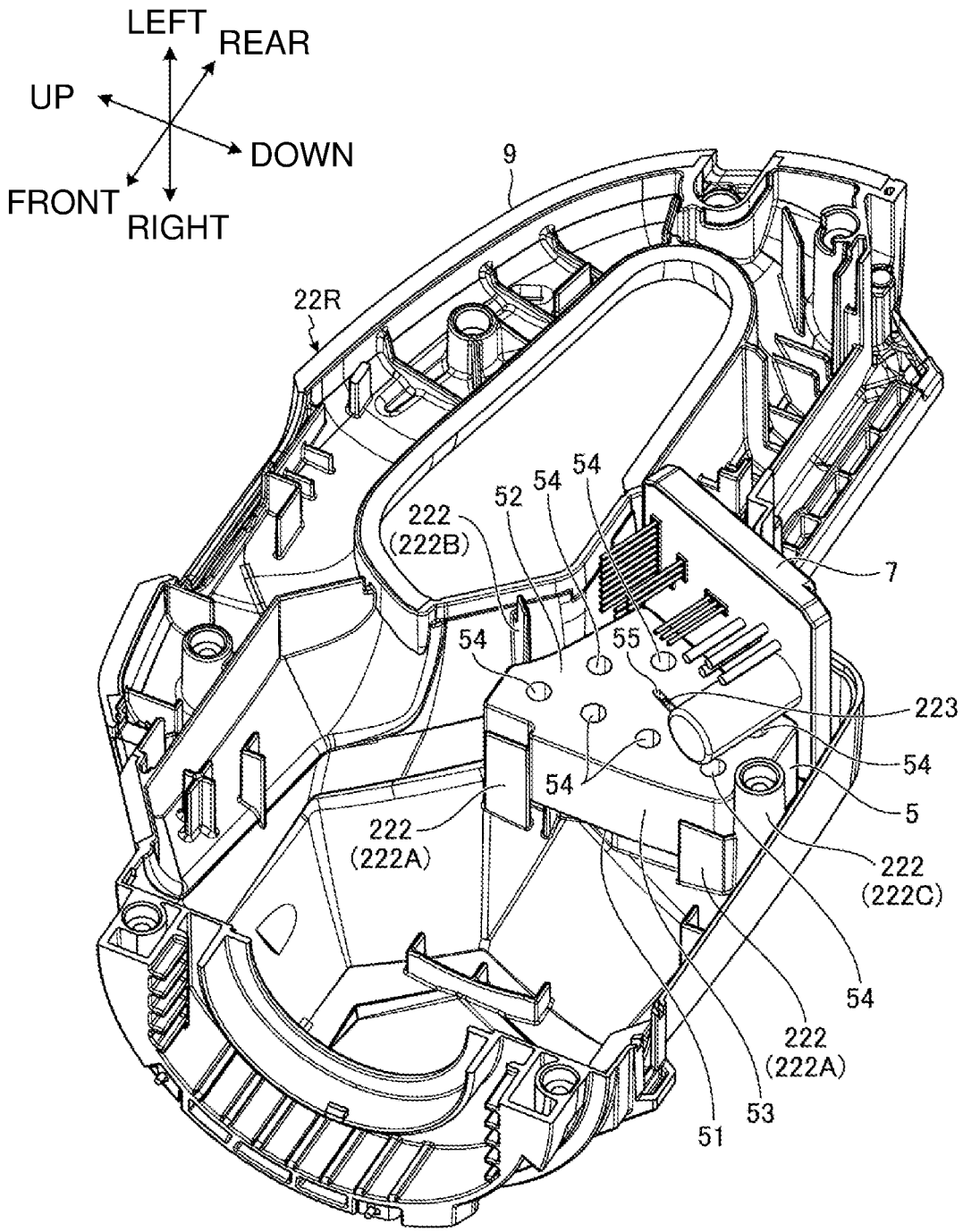
FIG. 6 is a perspective view of a right housing, a sound absorber, and a controller in the embodiment.
Figure 7:
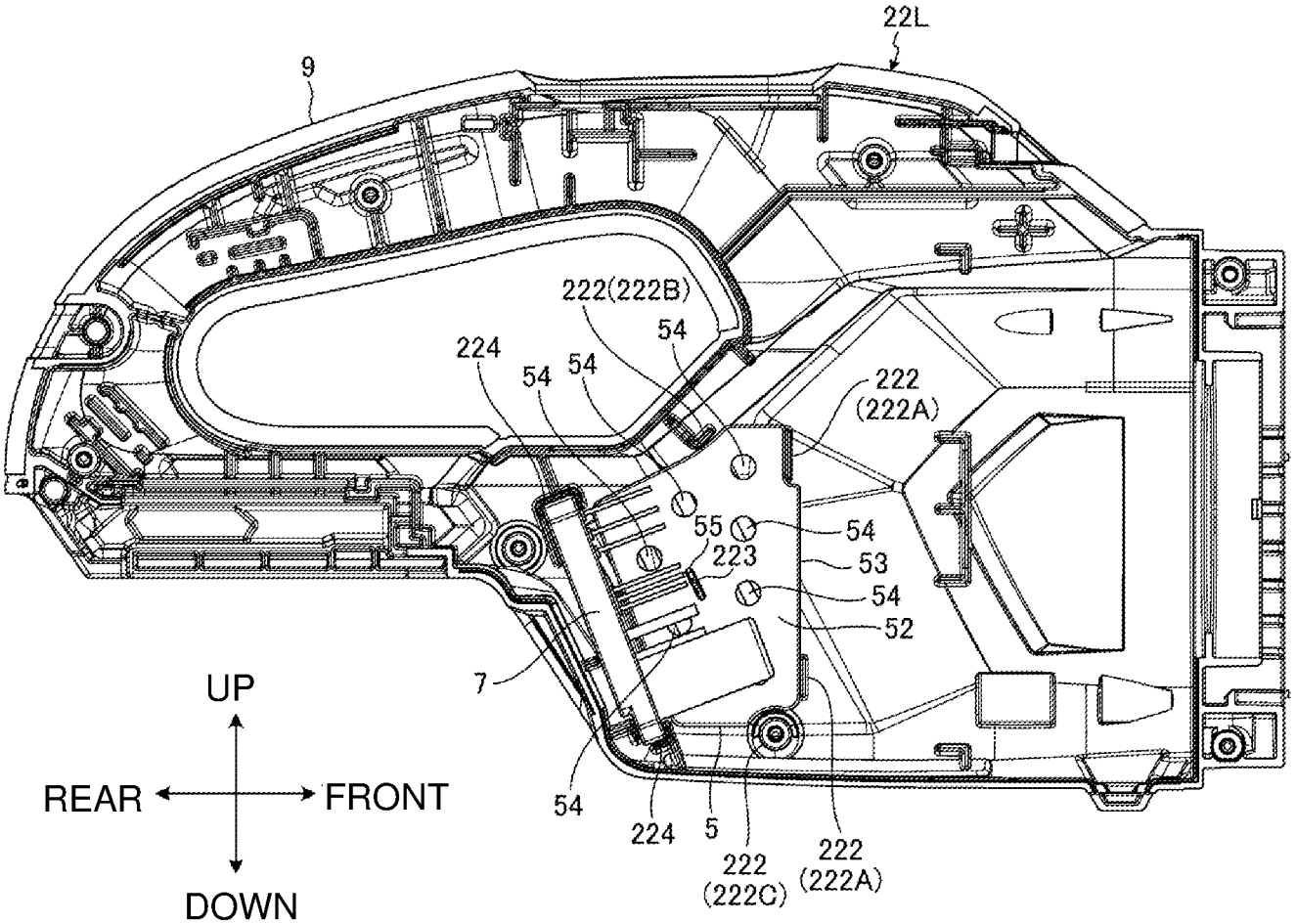
FIG. 7 is a side view of the left housing, the sound absorber, and the controller in the embodiment.
Figure 8:
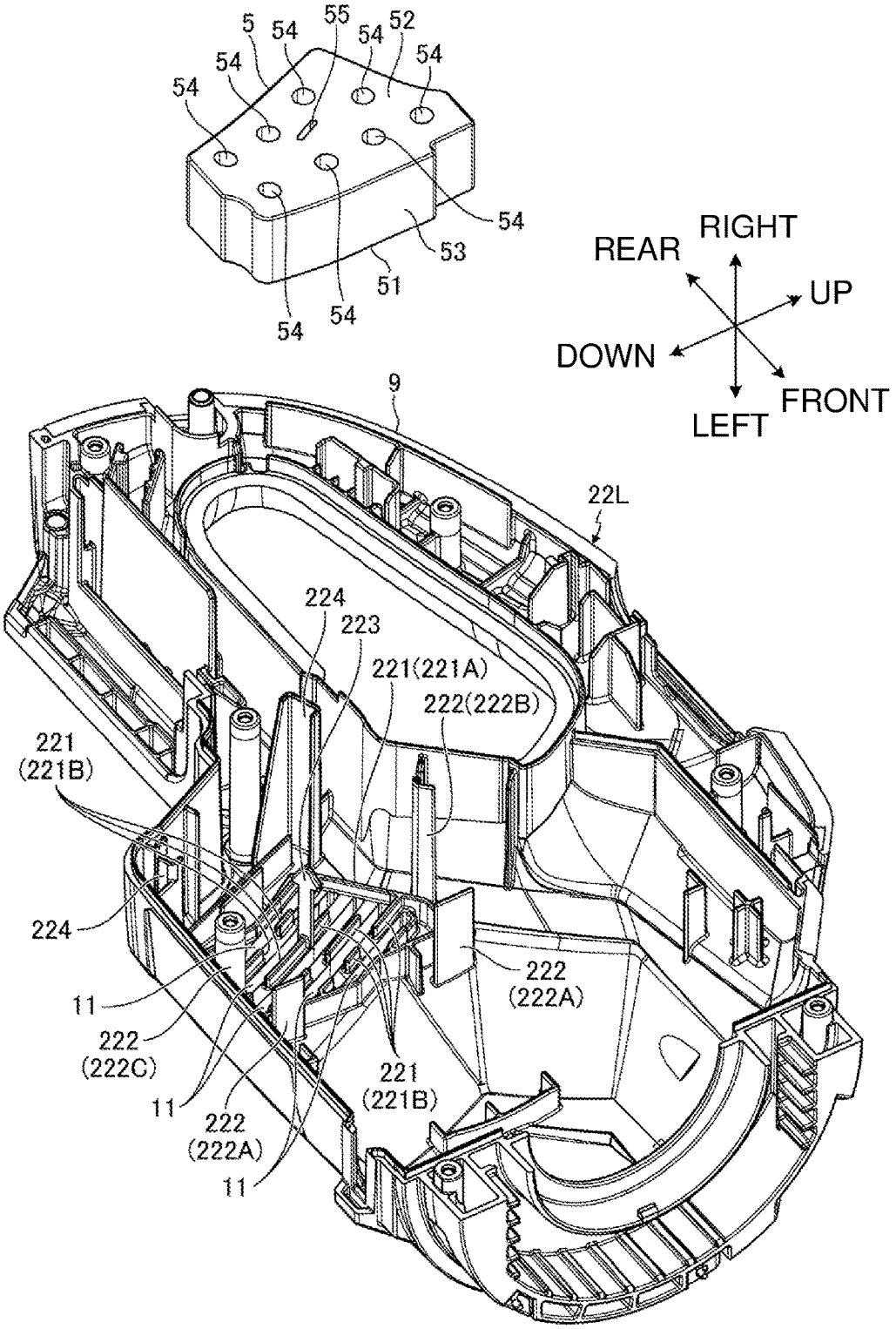
FIG. 8 is a perspective view of the left housing and the sound absorber in the embodiment that are shown separately.
Figure 9:
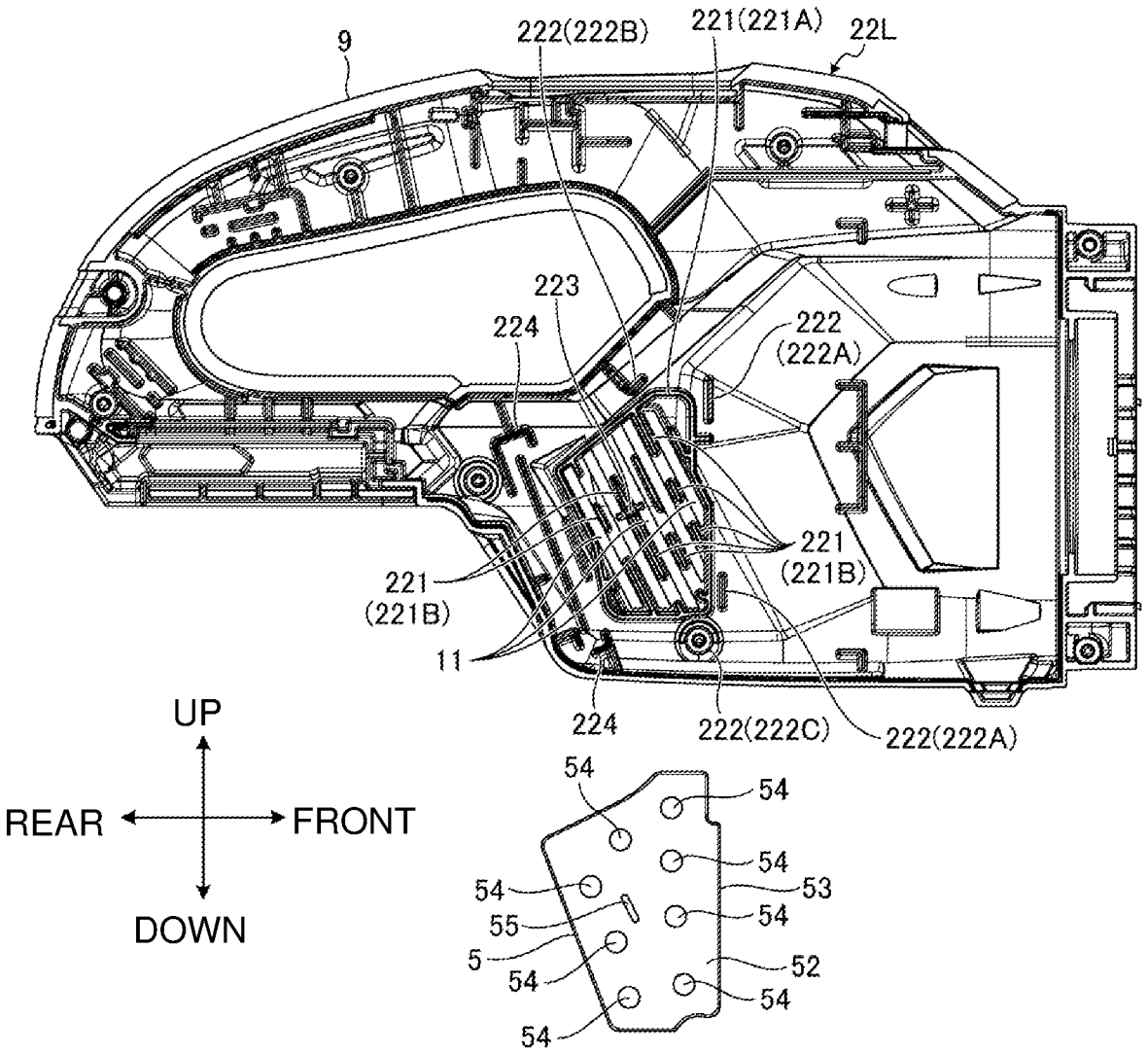
FIG. 9 is a side view of the left housing and the sound absorber in the embodiment that are shown separately.

FIG. 5 is a perspective view of the left housing 22L, the sound absorber 5, and the controller 7 in the embodiment. FIG. 6 is a perspective view of the right housing 22R, the sound absorber 5, and the controller 7 in the embodiment. FIG. 7 is a side view of the left housing 22L, the sound absorber 5, and the controller 7 in the embodiment. FIG. 8 is a perspective view of the left housing 22L and the sound absorber 5 in the embodiment that are shown separately. FIG. 9 is a side view of the left housing 22L and the sound absorber 5 in the embodiment that are shown separately.

Two sound absorbers 5 are located inside the rear housing 22. One sound absorber 5 inside the rear housing 22 faces the exhaust ports 11 on the left housing 22L. The other sound absorber 5 inside the rear housing 22 faces the exhaust ports 11 on the right housing 22R.

Each sound absorber 5 has a first surface 51, a second surface 52, and a peripheral surface 53. The second surface 52 faces in the direction opposite to the first surface 51. The peripheral surface 53 connects the peripheries of the first surface 51 and the second surface 52 to each other. Each sound absorber 5 is a block.

The sound absorber 5 is a porous material with open-cell foam and including many micropores. Open-cell foam includes interconnecting multiple pores. The porous material with open-cell foam may be at least one selected from flexible urethane sponge, glass wool, mineral wool, and felt.

Each sound absorber 5 has air passages 54 and a support slit 55. The air passages 54 extend through the first surface 51 and the second surface 52. The support slit 55 extends through the first surface 51 and the second surface 52. Each sound absorber 5 has multiple air passages 54. The air passages 54 extend substantially parallel to each other. Each sound absorber 5 has a single support slit 55.

Each air passage 54 has substantially perfectly circular openings at both ends (first and second openings). Each air passage 54 has an inner diameter larger than the size of each pore.

The support slit 55 has substantially elliptical openings at both ends. The support slit 55 has the openings each with a short-side dimension smaller than the dimension (diameter) of each air passage 54.

The exhaust ports 11 are elongated slits. The exhaust ports 11 are located at regular intervals in the short-side direction of the exhaust ports 11.

Each sound absorber 5 is located inside the rear housing 22 to have the air passages 54 with first openings at least partly overlapping the exhaust ports 11 and with second openings facing the internal space of the rear housing 22.

The rear housing 22 includes supports 221, supports 222, and supports 223. The supports 221 face the first surfaces 51 of the respective sound absorbers 5. The supports 222 face the peripheral surfaces 53 of the respective sound absorbers 5. The supports 223 are received in the respective support slits 55. The left housing 22L and the right housing 22R each include the support 221, the support 222, and the support 223.

The support 221, the support 222, and the support 223 in the left housing 22L protrude rightward from the inner surface of the left housing 22L. The support 221, the support 222, and the support 223 in the right housing 22R protrude leftward from the inner surface of the right housing 22R.

Each support 221 includes a peripheral wall 221A and ribs 221B. The peripheral wall 221A surrounds the exhaust ports 11. Each rib 221B is between adjacent exhaust ports 11. The peripheral wall 221A has substantially the same profile as the first surface 51. The peripheral wall 221A is in contact with the periphery of the first surface 51. The support 221 includes multiple ribs 221B. The ribs 221B are in contact with the first surface 51.

Each support 222 includes front supports 222A, an upper support 222B, and a lower support 222C. The front supports 222A are located frontward from the exhaust ports 11. The upper support 222B is located above the exhaust ports 11. The lower support 222C is located below the exhaust ports 11.

Each support 222 includes two front supports 222A. The front supports 222A are in contact with the front of the peripheral surface 53. The upper support 222B is in contact with the top of the peripheral surface 53. The lower support 222C is in contact with the bottom of the peripheral surface 53. The lower support 222C serves as a screw boss to receive at least a part of a screw 22S.

The support 223 protrudes from one rib 221B. The support 223 is received in the support slit 55.

The rear housing 22 includes a controller support 224 supporting the controller 7. The controller 7 is supported on the controller support 224 and located at the rear of the sound absorbers 5. The controller 7 is supported on the controller support 224 and faces the rear of the peripheral surfaces 53.

The sound absorbers 5 inside the housing 2 face the exhaust ports 11 to reduce noise. The sound absorbers 5 have the air passages 54. Air inside the housing 2 flows through the air passages 54 and then flows out of the housing 2. This structure allows air to smoothly flow from the inside to the outside of the housing 2. The sound absorbers 5 having the air passages 54 reduce noise without increasing the resistance to the air discharge flow. The cleaner 1 has smooth airflow and is less likely to decrease its suction power.

Each sound absorber 5 has the air passages 54 that allow air to flow smoothly. The sound absorbers 5 having the air passages 54 have larger surface areas, thus more effectively absorbing sound.

The air passages 54 extend substantially parallel to each other to allow air to flow smoothly.

Each sound absorber 5 is located to have the air passages 54 with their first openings at least partly facing the exhaust ports 11 and their second openings facing the center of the internal space of the housing 2. This structure allows air flowing through the second openings into the air passages 54 to flow out through the first openings and then to be smoothly discharged out of the housing 2 through the exhaust ports 11.

The exhaust ports 11 are elongated slits. This structure reduces the likelihood that external foreign objects enter the housing 2 through the exhaust ports 11. Each air passage 54 has an inner diameter at its first opening larger than the short-side dimension of each exhaust port 11. This structure allows air in the air passages 54 flowing out through the first openings to be smoothly discharged out of the housing 2 through the exhaust ports 11.

Multiple exhaust ports 11 are arranged in the short-side direction of the exhaust ports 11 to allow air to be smoothly discharged outside through the exhaust ports 11. Each air passage 54 has an inner diameter at its first opening larger than the interval between the exhaust ports 11 in the short-side direction. The first openings of the air passages 54 at least partly overlap the exhaust ports 11. In other words, the first openings of the air passages 54 are less likely to be blocked by the inner surface of the housing 2 between the exhaust ports 11. This structure allows air in the air passages 54 flowing out through the first openings to be smoothly discharged out of the housing 2 through the exhaust ports 11.

The air passages 54 are arranged in the short-side and long-side directions of the exhaust ports 11. This structure allows air inside the housing 2 to flow through the air passages 54 and then to be smoothly discharged out of the housing 2 through the exhaust ports 11.

The sound absorbers 5 are supported on the supports 223 protruding from the inner surface of the housing 2. The supports 223 are received in the respective support slits 55. The sound absorbers 5 are readily attached to the housing 2 by simply placing the supports 223 into the support slits 55. This structure improves the workability for attaching and detaching the sound absorbers 5 to and from the housing 2.

Each support 223 includes a hook at its distal end. The supports 223 may be received in the respective support slits 55 with the hooks hooked onto the second surfaces 52 of the sound absorbers 5. This structure allows the sound absorbers 5 to be stably attached to the housing 2 with the supports 223.

Suction Unit

Figure 10:
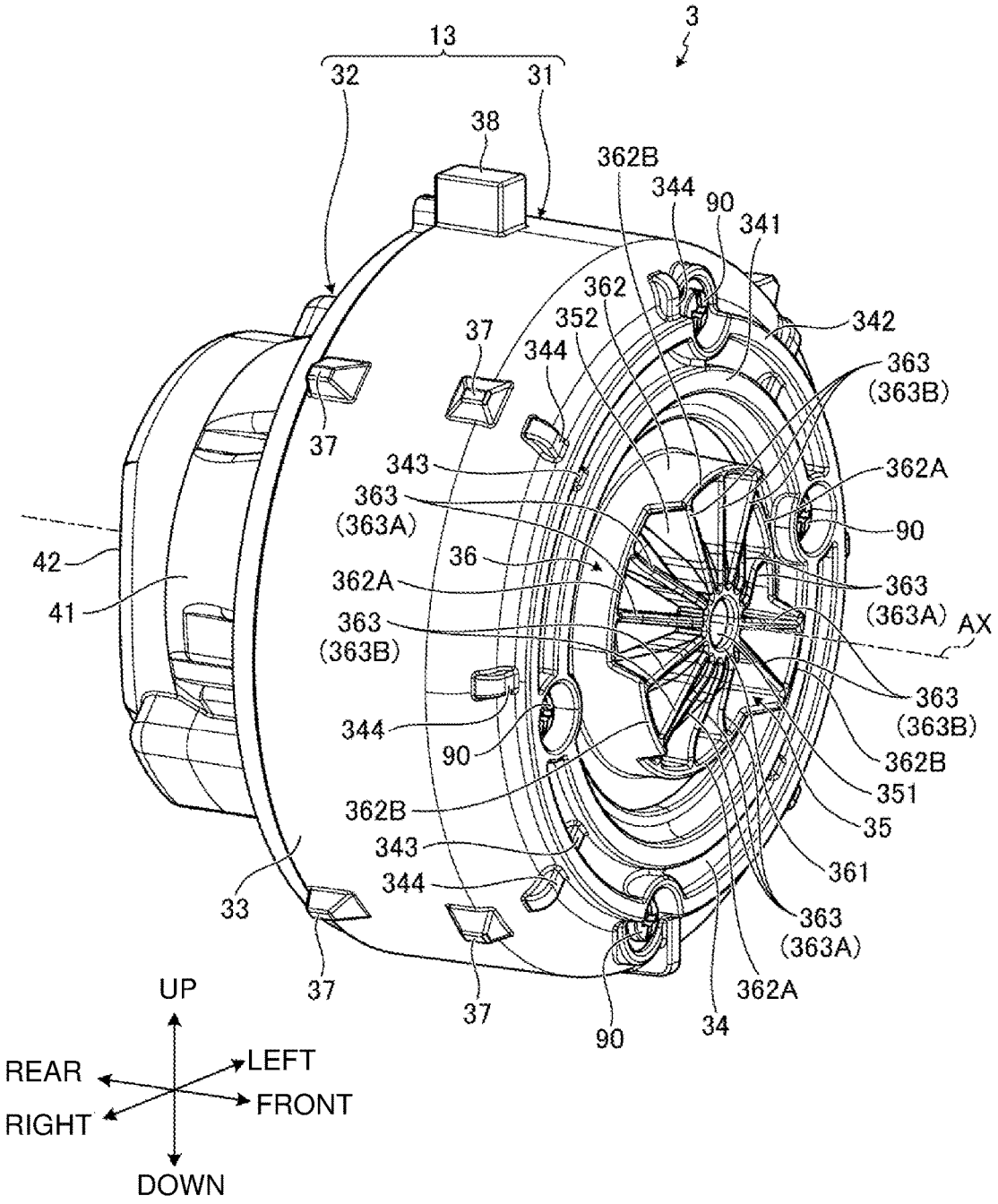
FIG. 10 is a front perspective view of a suction unit in the embodiment.
Figure 11:
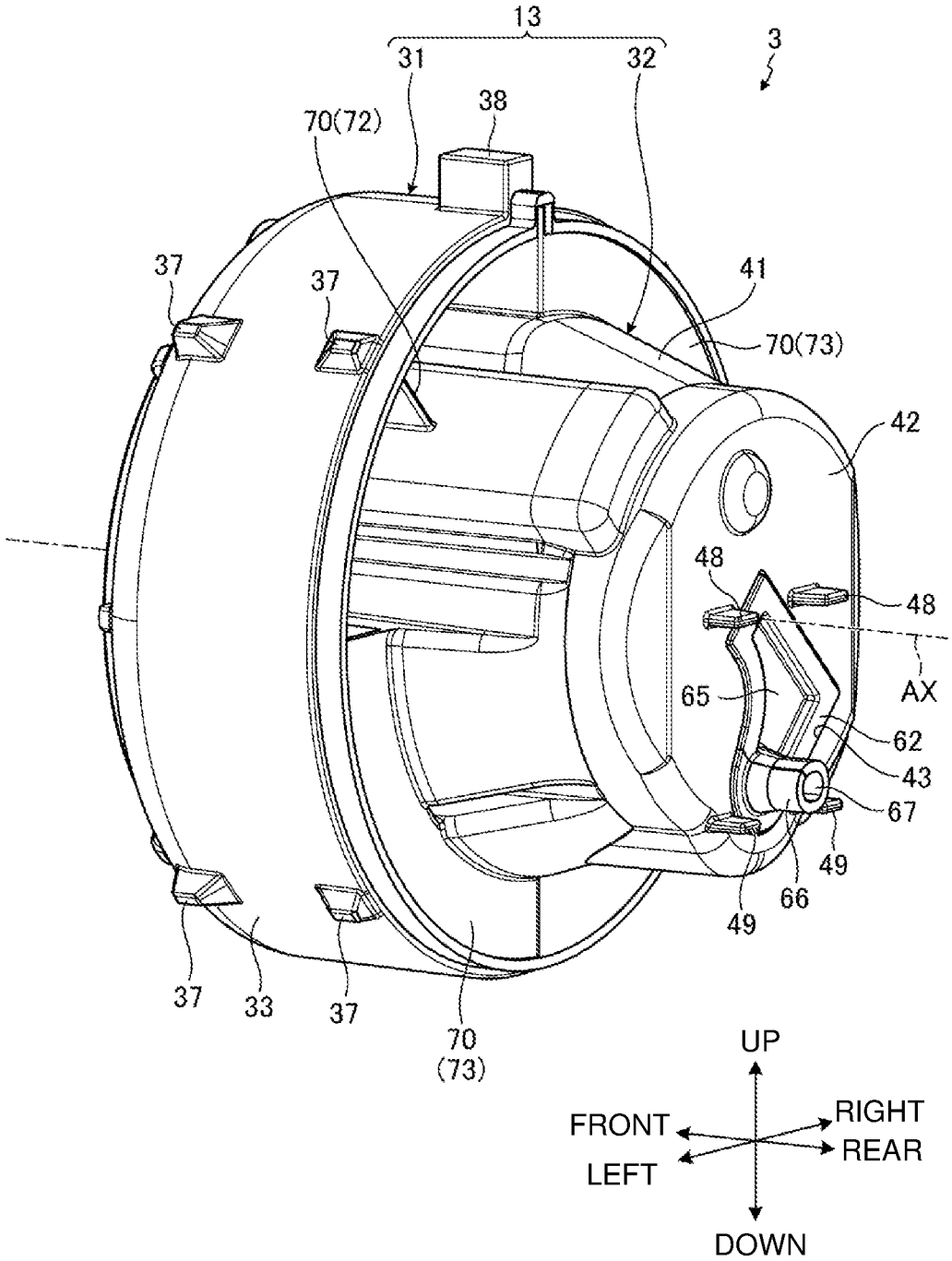
FIG. 11 is a rear perspective view of the suction unit in the embodiment.
Figure 12:
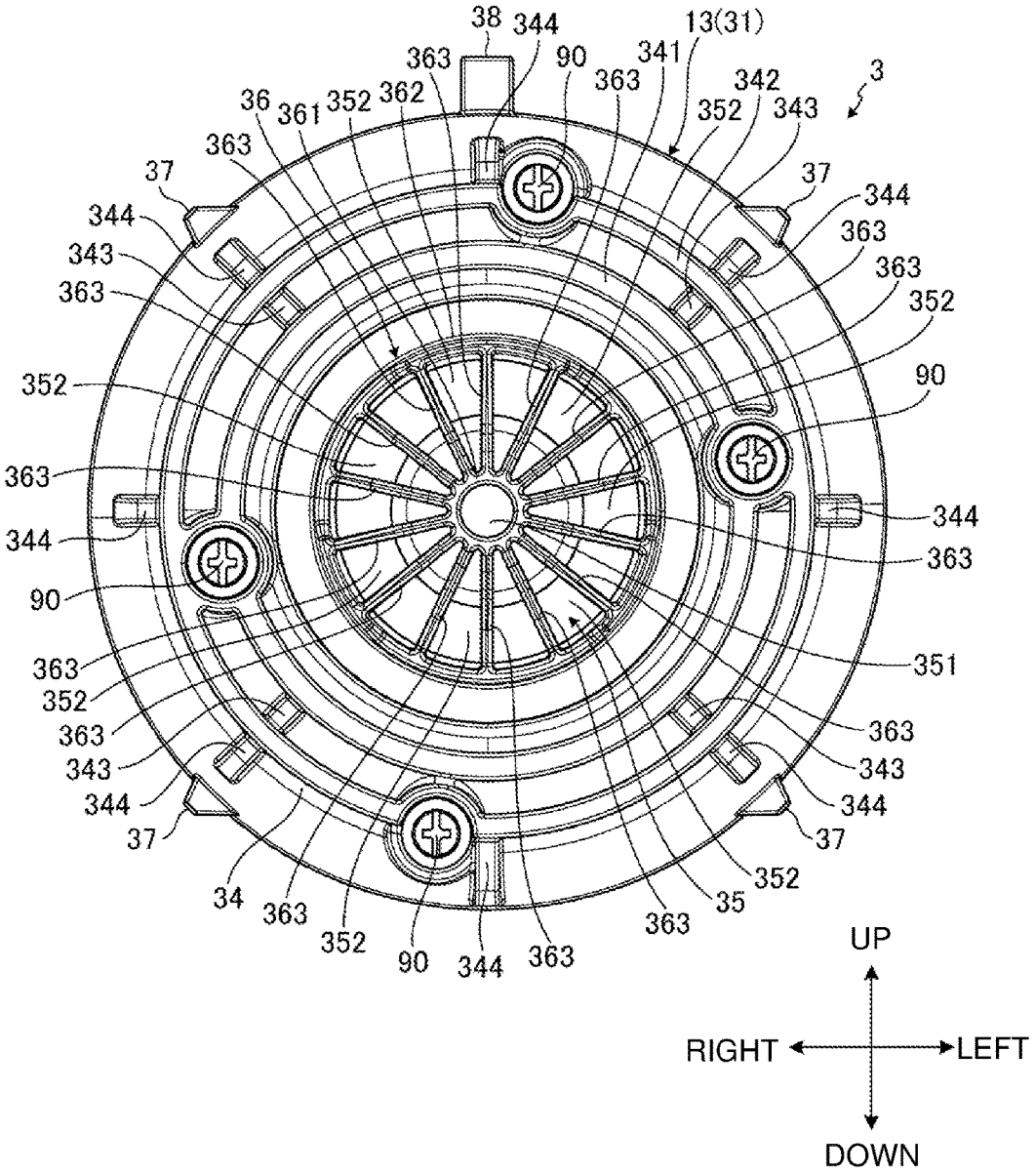
FIG. 12 is a front view of the suction unit in the embodiment.
Figure 13:
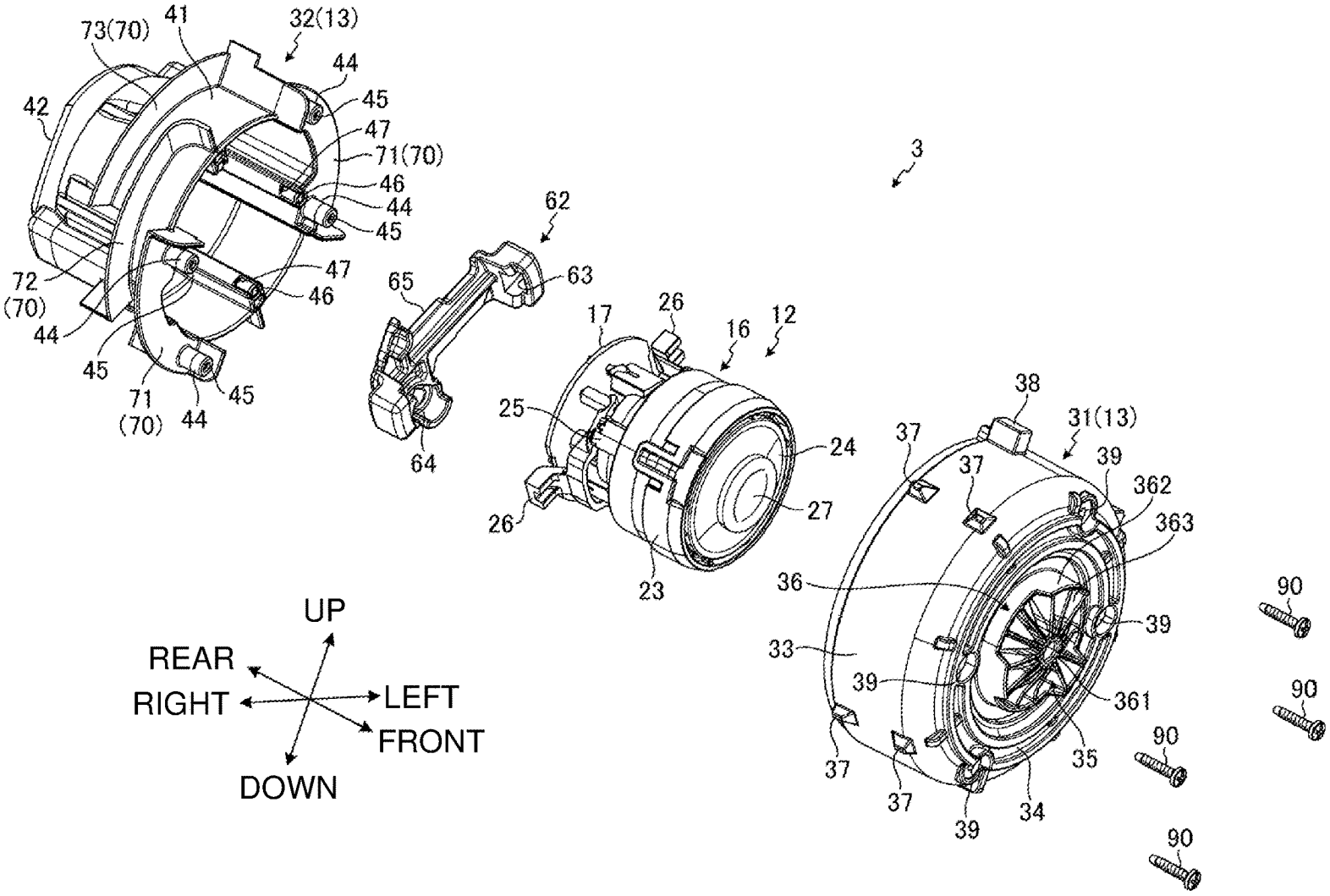
FIG. 13 is an exploded perspective view of the suction unit in the embodiment as viewed from the front.
Figure 14:
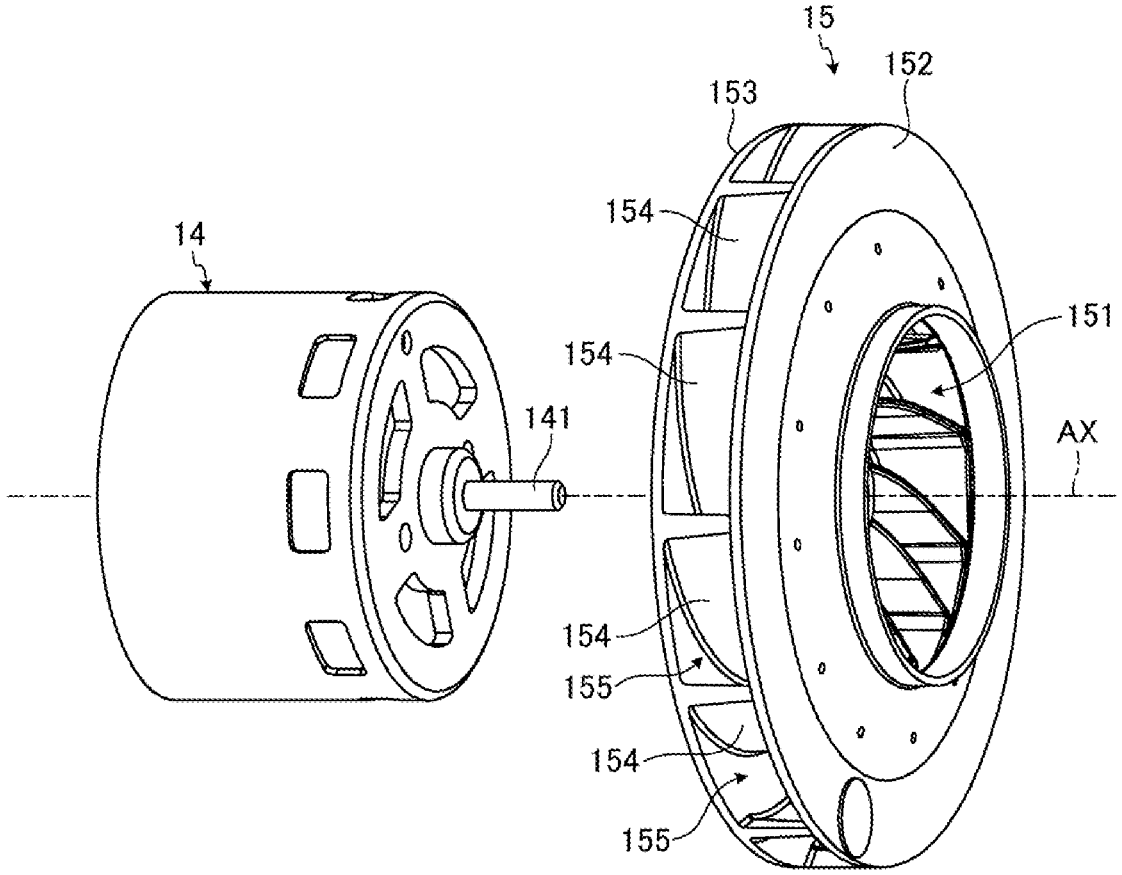
FIG. 14 is a perspective view of a motor and a fan in the embodiment.

FIG. 10 is a front perspective view of the suction unit 3 in the embodiment. FIG. 11 is a rear perspective view of the suction unit 3 in the embodiment. FIG. 12 is a front view of the suction unit 3 in the embodiment. FIG. 13 is an exploded perspective view of the suction unit 3 in the embodiment as viewed from the front. FIG. 14 is a perspective view of the motor 14 and the fan 15 in the embodiment. The suction unit 3 includes the motor assembly 12, the cover 13, and an elastic member 60.

Motor Assembly

The motor assembly 12 includes the motor 14, the fan 15, the motor case 16, and the control board 17.

The motor 14 generates a rotational force for rotating the fan 15. The motor 14 is an inner-rotor motor. The motor 14 includes a rotor shaft 141 rotatable about the rotation axis AX. The fan 15 is fixed to the front of the rotor shaft 141.

The fan 15 is located frontward from the motor 14. The fan 15 is rotatable about the rotation axis AX with the rotational force generated by the motor 14. The fan 15 is a centrifugal fan. As shown in FIG. 14, the fan 15 includes a front plate 152, a rear plate 153, and blades 154. The front plate 152 includes an inlet 151. The rear plate 153 is located rearward from the front plate 152. The blades 154 are between the front plate 152 and the rear plate 153.

Multiple blades 154 are arranged to surround the rotation axis AX. Each blade 154 has the same shape, and has the same dimensions in the circumferential, radial, and axial directions. The blades 154 are located at equal intervals in the circumferential direction.

Adjacent blades 154 define an outlet 155. The rotating fan 15 draws air frontward from the fan 15 into the inlet 151. The air drawn into the inlet 151 flows between the blades 154 and is then discharged radially outward through the outlets 155.

The motor case 16 accommodates the motor 14 and the fan 15. The motor case 16 includes a cylinder 23, a fan cover 24, a support 25, and legs 26.

The cylinder 23 has the rotation axis AX at the center. The fan cover 24 is located frontward from the fan 15. The fan cover 24 is at the front end of the cylinder 23. The support 25 supports the motor 14 and the control board 17. The legs 26 are fixed to the support 25. The motor case 16 includes two legs 26. The legs 26 are located radially outward from the outer surface of the cylinder 23.

The motor case 16 has an inflow port 27 and an outflow port 28. The inflow port 27 is at the front end of the motor case 16. The outflow port 28 is located rearward from the inflow port 27. The inflow port 27 in the embodiment is at the center of the fan cover 24. The outflow port 28 is defined by the rear end of the cylinder 23 and the outer surface of the support 25. The air from the fan 15 is discharged backward from the motor case 16 through the outflow port 28.

The control board 17 outputs control signals for controlling the motor 14. The control board 17 is located rearward from the support 25. The control board 17 faces the rear of the support 25. The control board 17 is supported on the support 25. The control board 17 is between the two legs 26.

Cover

The cover 13 surrounds and accommodates the motor assembly 12. The cover 13 is fixed to the housing 2.

The cover 13 includes a first cover 31 and a second cover 32. The second cover 32 is at least partly located rearward from the first cover 31. The second cover 32 is connected to the first cover 31 in a detachable manner. The first cover 31 and the second cover 32 define the internal space of the cover 13 for accommodating the motor assembly 12.

The first cover 31 includes a cylinder 33, a front plate 34, an inlet 35, a flow straightener 36, protrusions 37, and a protrusion 38.

The cylinder 33 is substantially cylindrical. The cylinder 33 has the rotation axis AX at the center. The cylinder 33 has an outer surface facing radially outward and an inner surface facing radially inward.

The front plate 34 is connected to the front end of the cylinder 33. The front plate 34 has a substantially circular profile. The front plate 34 has a front surface facing frontward and a rear surface facing rearward.

The inlet 35 is at the center of the front plate 34. The inlet 35 has a through-hole connecting the front surface and the rear surface of the front plate 34.

The front plate 34 includes a ring 341, a ring 342, multiple ribs 343, and multiple ribs 344 on the front surface. The ring 341, the ring 342, the ribs 343, and the ribs 344 protrude frontward from the front surface of the front plate 34.

The ring 341 surrounds the inlet 35. The ring 342 surrounds the ring 341. The ribs 343 extend in the radial direction. The ribs 343 are between the ring 341 and the ring 342 in the radial direction. The ribs 343 are connected to each of the ring 341 and the ring 342. The ribs 343 are located at intervals in the circumferential direction. The ribs 344 extend in the radial direction. The ribs 344 are located radially outward from the ring 342. The ribs 344 are connected to the ring 342. The ribs 344 are located at intervals in the circumferential direction.

The ring 341 has the front end located frontward from the front ends of the ribs 343 and the front ends of the ribs 344. The ring 342 has the front end located frontward from the front ends of the ribs 343 and the front ends of the ribs 344.

The flow straightener 36 is located at the inlet 35. The flow straightener 36 guides air being sucked into the inlet 35. The flow straightener 36 includes an inner ring 361, an outer ring 362, and multiple ribs 363.

The inner ring 361, the outer ring 362, and the ribs 363 have the front ends located frontward from the front surface of the front plate 34. The inner ring 361 is at the center of the inlet 35. The outer ring 362 surrounds the inner ring 361. The outer ring 362 defines the profile of the inlet 35. The inlet 35 in the embodiment has a circular profile.

The ribs 363 extend in the radial direction. Each rib 363 has the same dimension in the circumferential direction. Each rib 363 has the same dimension in the radial direction. The ribs 363 are located at equal intervals in the circumferential direction. The ribs 363 are between the inner ring 361 and the outer ring 362 in the radial direction. The ribs 363 are connected to each of the inner ring 361 and the outer ring 362. The ribs 363 have radially inner ends connected to the inner ring 361. The ribs 363 have radially outer ends connected to the outer ring 362.

The outer ring 362 is fixed to the front plate 34. The inner ring 361 is fixed to the outer ring 362 with the ribs 363.

The inlet 35 in the embodiment includes a first inlet 351 and second inlets 352. The first inlet 351 is defined inside the inner ring 361. Each second inlet 352 is defined between adjacent ribs 363. The first inlet 351 has a circular profile. The rotation axis AX extends through the first inlet 351. Multiple second inlets 352 are arranged in the circumferential direction. Each second inlet 352 has a substantially triangular profile. The first inlet 351 and the second inlets 352 allow air to flow.

The outer ring 362 includes first portions 362A and second portions 362B. Each first portion 362A has a first dimension in the axial direction. Each second portion 362B has a second dimension larger than the first dimension in the axial direction. The first portions 362A have the front ends located rearward from the front ends of the second portions 362B. The outer ring 362 includes multiple (three in the present embodiment) first portions 362A located at intervals in the circumferential direction. Each second portion 362B is between adjacent first portions 362A in the circumferential direction. The outer ring 362 in the present embodiment includes three second portions 362B arranged in the circumferential direction.

The second portions 362B have the front ends located frontward from the front ends of the first portions 362A. The second portions 362B have the front ends at substantially the same position as the front end of the inner ring 361 in the axial direction. The front end of each first portion 362A and the front end of the corresponding second portion 362B form a step between them.

The ribs 363 include first ribs 363A and second ribs 363B. The first ribs 363A are connected to the first portions 362A. The second ribs 363B are connected to the second portions 362B. The first portions 362A have the front ends at substantially the same position as the front, radially outer ends of the first ribs 363A in the axial direction. The second portions 362B have the front ends at substantially the same position as the front, radially outer ends of the second ribs 363B in the axial direction. In other words, the first ribs 363A have the radially outer ends not protruding frontward from the first portions 362A. The second ribs 363B have the radially outer ends not protruding frontward from the second portions 362B. The first ribs 363A have the front ends at least partly located rearward from the front ends of the second ribs 363B.

The protrusions 37 are located on the outer surface of the cylinder 33. The protrusions 37 protrude radially outward from the outer surface of the cylinder 33. Four protrusions 37 are located at intervals in the circumferential direction. Two protrusions 37 are arranged in the axial direction. In other words, eight protrusions 37 are arranged on the outer surface of the cylinder 33.

The protrusion 38 is located on the outer surface of the cylinder 33. The protrusion 38 protrudes radially outward from the outer surface of the cylinder 33. The single protrusion 38 is located on the outer surface of the cylinder 33 at the top.

The front plate 34 has multiple (four in the present embodiment) screw openings 39.

The cylinder 33, the front plate 34, the flow straightener 36, the protrusions 37, and the protrusion 38 are integral with one another. The first cover 31 is formed by insert molding. The first cover 31 includes a base formed from a synthetic resin. The synthetic resin is, for example, polypropylene. The base is covered with an elastomer. The elastomer is, for example, synthetic rubber.

The outer surface of the cylinder 33, the ring 341, the ring 342, the ribs 343, the ribs 344, the protrusions 37, and the protrusion 38 in the embodiment are formed from an elastomer. The inner surface of the cylinder 33 and the flow straightener 36 are formed from a synthetic resin.

As shown in FIG. 3, the rear housing 22 includes a ring 225 located frontward from the cover 13. The ring 225 is fixed to the inner surface of the rear housing 22. The ring 225 has the rear surface in contact with the front surfaces of the rings 341 and 342. Thus, the cover 13 and the housing 2 are positioned relative to each other.

The protrusions 37 are in contact with the inner surface of the rear housing 22. Thus, the cover 13 and the housing 2 are positioned relative to each other.

The protrusion 38 is at least partly in contact with the inner surface of the rear housing 22. Thus, the cover 13 and the housing 2 are positioned relative to each other.

The ring 341, the ring 342, the protrusions 37, and the protrusion 38 in contact with the rear housing 22 are elastically deformable. This reduces transmission of vibrations from the suction unit 3 to the housing 2.

The second cover 32 includes a cylinder 41, a rear plate 42, an opening 43, screw bosses 44, supports 47, protrusions 48, protrusions 49, and a guide 70. Each screw boss 44 has a screw hole 45. The supports 47 support pins 46.

The cylinder 41 is substantially cylindrical. The cylinder 41 has the rotation axis AX at the center. The cylinder 41 has an outer surface facing radially outward and an inner surface facing radially inward. The cylinder 41 in the embodiment has a rear portion with its inner diameter decreasing toward the rear end.

The rear plate 42 is connected to the rear end of the cylinder 41. The rear plate 42 has a substantially circular profile. The rear plate 42 has a front surface facing frontward and a rear surface facing rearward.

The opening 43 is in the rear plate 42. The opening 43 includes a through-hole connecting the front surface and the rear surface of the rear plate 42.

The second cover 32 includes multiple (four in the present embodiment) screw bosses 44 at the front. The screw bosses 44 each have the screw hole 45.

The supports 47 support the pins 46. The pins 46 are formed from rubber. The supports 47 define recesses on the inner surface of the cylinder 41. Four supports 47 are located at intervals in the circumferential direction. The four supports 47 support the respective pins 46. The four pins 46 are in contact with the outer surface of the cylinder 23 in the motor case 16. The four pins 46 allow the second cover 32 to be positioned relative to the motor case 16.

The protrusions 48 protrude rearward from upper positions on the rear surface of the rear plate 42. The second cover 32 includes two protrusions 48 aligning in the lateral direction. As shown in FIG. 3, the protrusions 48 are in contact with the sound absorbers 5. The left protrusion 48 supports the sound absorber 5 at the exhaust ports 11 in the left housing 22L. The right protrusion 48 supports the sound absorber 5 at the exhaust ports 11 in the right housing 22R.

The protrusions 49 protrude rearward from lower positions on the rear surface of the rear plate 42. The second cover 32 includes two protrusions 49 aligning in the lateral direction. As shown in FIG. 3, the protrusions 49 are in contact with the sound absorbers 5. The left protrusion 49 supports the sound absorber 5 at the exhaust ports 11 in the left housing 22L. The right protrusion 49 supports the sound absorber 5 at the exhaust ports 11 in the right housing 22R.

The guide 70 is fixed to the outer surface of the cylinder 41. The guide 70 protrudes radially outward from the outer surface of the cylinder 41. The guide 70 in the embodiment includes first guides 71, second guides 72, and third guides 73. The guide 70 in the embodiment includes two first guides 71, two second guides 72, and two third guides 73.

The two first guides 71 are located opposite to each other in the radial direction. The two second guides 72 are located opposite to each other in the radial direction. The two third guides 73 are located opposite to each other in the radial direction.

One first guide 71 includes the first and second screw bosses 44. The other first guide 71 includes the third and fourth screw bosses 44. The screw bosses 44 protrude frontward from the first guides 71.

The cylinder 41, the rear plate 42, the screw bosses 44, the supports 47, the protrusions 48, the protrusions 49, and the guide 70 in the embodiment are integral with one another. The second cover 32 is formed from a synthetic resin. The synthetic resin used for the second cover 32 is, for example, acrylonitrile butadiene styrene (ABS).

The elastic member 60 is between the cover 13 and at least a part of the motor case 16. The elastic member 60 reduces transmission of vibrations from the motor 14 or the fan 15 to the cover 13.

The elastic member 60 in the embodiment includes a first elastic member 61 and a second elastic member 62. The first elastic member 61 is at least partly located frontward from the motor case 16. The second elastic member 62 is at least partly located rearward from the motor case 16.

The first elastic member 61 reduces transmission of vibrations from the motor 14 or the fan 15 to the first cover 31. The first elastic member 61 is between the surface of the fan cover 24 in the motor case 16 and the rear surface of the front plate 34 in the first cover 31. The rear surface of the front plate 34 in the first cover 31 faces at least a part of the surface of the fan cover 24 in the motor case 16. The front plate 34 in the first cover 31 has the inlet 35 located frontward from the fan cover 24. The first elastic member 61 is annular and surrounds the inlet 35. The first elastic member 61 is connected to the rear surface of the front plate 34.

The first elastic member 61 is molded integrally with the first cover 31. The first elastic member 61 may be a part of the first cover 31. The first cover 31 may be formed by insert molding as described above. In this case, the first elastic member 61 may be formed from an elastomer that covers the base of the first cover 31.

The second elastic member 62 reduces transmission of vibrations from the motor 14 or the fan 15 to the second cover 32. The second elastic member 62 is between the motor case 16 and the rear plate 42 in the second cover 32. The second cover 32 has the opening 43 located rearward from the motor case 16. The second elastic member 62 is connected to at least a part of the motor case 16 with the second elastic member 62 blocking the opening 43. The second elastic member 62 in the embodiment is connected to the legs 26 on the motor case 16.

The second elastic member 62 includes a first connector 63, a second connector 64, a blocker 65, and a pipe 66. The first connector 63 is fixed to one leg 26. The second connector 64 is fixed to the other leg 26. The blocker 65 is between the first connector 63 and the second connector 64. The blocker 65 is inside the opening 43. The pipe 66 protrudes rearward from the rear surface of the blocker 65. The pipe 66 has a support hole 67.

Assembling Suction Unit

Assembling the suction unit 3 involves connecting the second elastic member 62 to the legs 26 on the motor case 16. A cable (not shown) connected to the control board 17 is placed in the support hole 67 in the second elastic member 62. The second elastic member 62 is connected to the legs 26 on the motor case 16 with the cable received in the support hole 67. The first connector 63 in the second elastic member 62 is hooked on one leg 26, and the second connector 64 is hooked on the other leg 26. The second elastic member 62 is thus connected to the motor case 16.

The two legs 26 protrude radially outward from the outer surface of the cylinder 23. The second elastic member 62, which has a larger radial dimension than the cylinder 23, can be appropriately connected to the motor case 16 with the legs 26.

The second elastic member 62 is connected to the motor case 16 with the blocker 65 facing the control board 17. The first connector 63 and the second connector 64 are located radially outward from the control board 17.

The motor case 16 and the second elastic member 62 connected together are then connected to the second cover 32. The motor case 16 and the second elastic member 62 are placed inside the second cover 32 through the front opening in the second cover 32. The motor case 16 and the second elastic member 62 are placed inside the second cover 32 with the blocker 65 blocking the opening 43 in the second cover 32. The pins 46 come in contact with the outer surface of the cylinder 23 in the motor case 16 placed inside the second cover 32. The motor case 16 is positioned with the pins 46. The cable connected to the control board 17 at least partly extends rearward from the rear end of the support hole 67.

The second cover 32 is connected to the motor assembly 12 and the second elastic member 62, and is then connected to the first cover 31. The cylinder 33 in the first cover 31 has an inner diameter larger than the outer diameter of the cylinder 41 in the second cover 32. The first cover 31 and the second cover 32 are connected together with the inner surface of the cylinder 33 and at least a part of the outer surface of the cylinder 41 facing each other. The cylinder 41 includes the guide 70 on the outer surface. The first cover 31 and the second cover 32 are connected together with the guide 70 located inside the cylinder 33. The guide 70 is between the inner surface of the cylinder 33 and the outer surface of the cylinder 41.

The first cover 31 has the screw openings 39. The second cover 32 has the screw holes 45. The first cover 31 and the second cover 32 are fastened together with four screws 90. The screws 90 are placed into the screw openings 39 from the front of the first cover 31. The screws 90 are then placed into and received in the screw holes 45. The screws 90 thus fasten the first cover 31 and the second cover 32 together.

Operation

The operation of the cleaner 1 according to the embodiment will now be described. The motor 14 that is stopped starts running in response to the drive button 81 being pushed by the user. The motor 14 runs on power supplied from the battery pack 19. The motor 14 runs and rotates the fan 15, which then generates a suction force through the suction port 10. This causes air outside the housing 2 to be sucked through the suction port 10 into the front housing 21.

Dust in the air entering the front housing 21 is then collected on the filter 18. The air through the filter 18 is sucked into the inlet 35 in the suction unit 3.

Figure 15:
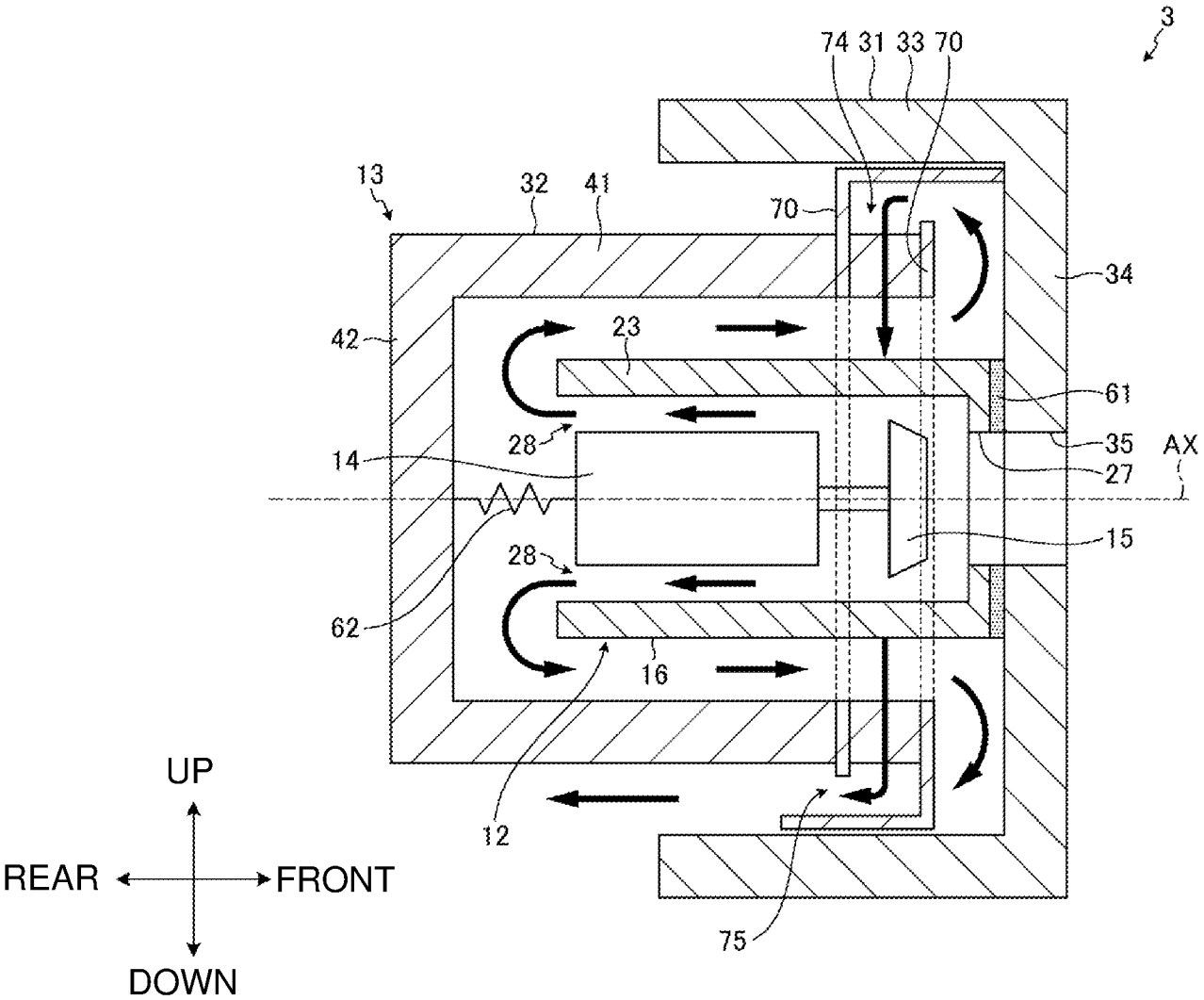
FIG. 15 is a schematic diagram of the suction unit in the embodiment describing airflow.

FIG. 15 is a schematic diagram of the suction unit 3 in the embodiment describing airflow. Air is sucked into the inlet 35 as the fan 15 rotates, and flows into the motor case 16 through the inflow port 27. The air from the fan 15 is discharged backward from the motor case 16 through the outflow port 28.

The air discharged backward through the outflow port 28 hits the front surface of the rear plate 42 in the second cover 32, and then flows forward between the outer surface of the cylinder 23 in the motor case 16 and the inner surface of the cylinder 41 in the second cover 32. The air hits the rear surface of the front plate 34 in the first cover 31 and then flows onto and along the outer surface of the cylinder 41 from its front end.

The air flowing onto and along the outer surface of the cylinder 41 is guided by the guide 70 in the circumferential direction. The air flows in the circumferential direction through a flow path 74 defined by the guide 70. The air through the flow path 74 then flows backward from the second cover 32 through a discharge port 75 defined by the guide 70. The air flowing through the discharge port 75 is then discharged out of the housing 2 through the exhaust ports 11.

The guide 70 guides air in the circumferential direction along the outer surface of the second cover 32. This structure allows air to travel a longer distance inside the housing 2, thus reducing noise.

Relationship Between Ribs and Fan

As described above, the suction unit 3 includes the motor 14, the fan 15, the cover 13 having the inlet 35, and the ribs 363. The fan 15 is rotatable about the rotation axis AX by the motor 14. The inlet 35 in the cover 13 is located frontward from the fan 15. The ribs 363 are located in the inlet 35 and extend radially from the rotation axis AX. The fan 15 includes the blades 154. The ribs 363 are arranged in the circumferential direction.

Each blade 154 has the same shape, and has the same dimensions in the circumferential, radial, and axial directions. The blades 154 are located at equal intervals in the circumferential direction.

Each rib 363 has the same dimension in the circumferential direction. Each rib 363 has the same dimension in the radial direction. The ribs 363 are located at equal intervals in the circumferential direction.

The fan 15 rotating behind the ribs 363 may produce noise (NZ). The rotating fan 15 causes the blades 154 to move behind the ribs 363. This causes air to be compressed to increase the pressure between the ribs 363 and the blades 154. The increasing pressure between the ribs 363 and the blades 154 may cause noise.

Figure 16:
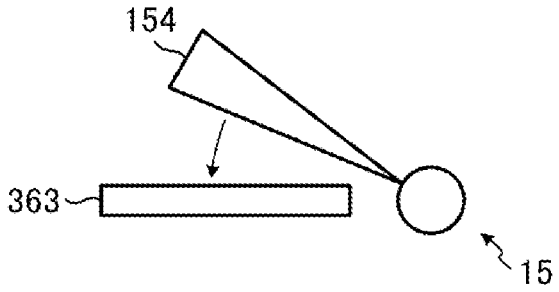
FIG. 16 is a schematic diagram of a rib and a blade in the embodiment.
Figure 17:
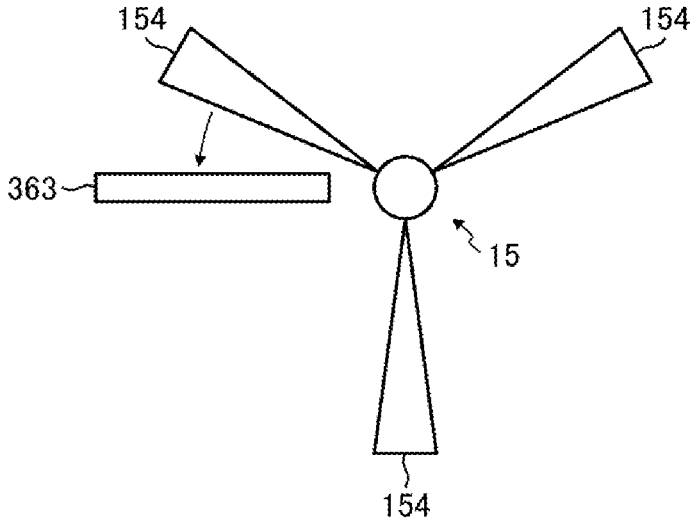
FIG. 17 is a schematic diagram of a rib and blades in an embodiment.
Figure 18:
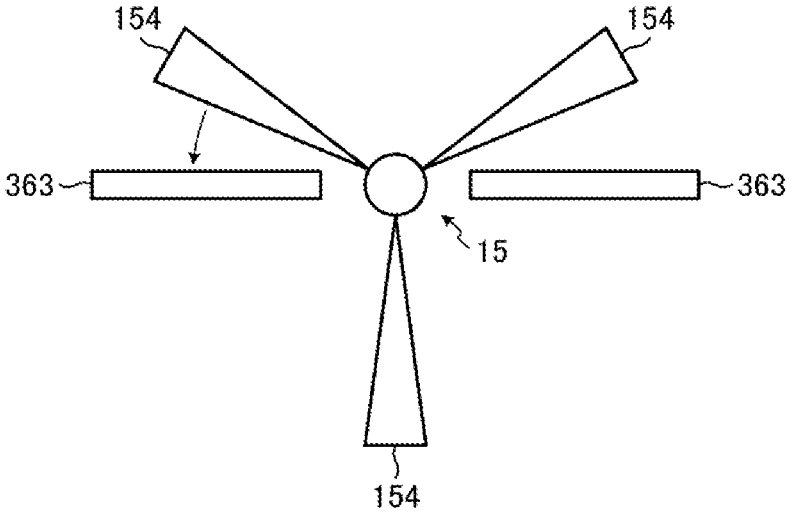
FIG. 18 is a schematic diagram of ribs and blades in an embodiment.

FIGS. 16 to 18 are schematic diagrams of the ribs 363 and the blades 154 in embodiments.

FIG. 16 shows the structure including one blade 154 (Z=1, where Z is the number of blades 154) and one rib 363 (V=1, where V is the number of ribs 363). In this case, the pressure between the rib 363 and the blade 154 increases once per rotation of the fan 15. For the fan 15 rotating at a rotational speed N of 60 rpm, the pressure increases 60 times per minute. This produces noise with the frequency $f_{NZ}$ being 1 Hz.

FIG. 17 shows the structure including three blades 154 (Z=3) and one rib 363 (V=1). In this case, the pressure between the rib 363 and the blades 154 increases three times per rotation of the fan 15. For the fan 15 rotating at a rotational speed N of 60 rpm, the pressure increases 180 times per minute. This produces noise with the frequency $f_{NZ}$ being 3 Hz.

FIG. 18 shows the structure including three blades 154 (Z=3) and two ribs 363 (V=2). In this case, the pressure between the ribs 363 and the blades 154 increases six times per rotation of the fan 15. For the fan 15 rotating at a rotational speed N of 60 rpm, the pressure increases 360 times per minute. This produces noise with the frequency $f_{NZ}$ being 6 Hz.

In the present embodiment, the number Z of blades 154, the number V of ribs 363, and the rotational speed N of the fan 15 indicating the revolutions per minute are determined to cause the rotating fan 15 to produce noise having the frequency $f_{NZ}$ of 20,000 Hz or higher.

The range of human hearing is specified to be higher than or equal to 15 Hz and lower than 20,000 Hz. Humans cannot hear noise from the rotating fan 15 having the frequency $f_{NZ}$ of 20,000 Hz or higher. In other words, setting the frequency $f_{NZ}$ of noise to 20,000 Hz or higher can reduce noise audible to humans.

The frequency $f_{NZ}$ of noise is expressed by formula (1) below.

$$f_{NZ}=(m-k\times V)\times N/60 \tag{1}$$

In the formula, m is an integer, k is an integer, V is the number of ribs 363, and N is the rotational speed of the fan 15 indicating the revolutions per minute (rpm).

The integer m in formula (1) is expressed by formula (2) below.

$$m=n\times Z+k\times V \tag{2}$$

In the formula, n is the order (natural number), and Z is the number of blades 154.

The integer m is a value associated with the attenuation rate of noise with respect to the distance from the cleaner 1 (the fan 15 or the ribs 363). The integer m having a smaller absolute value |m| indicates a smaller attenuation rate of noise from the cleaner 1, indicating that the noise reaches farther.

Formula (3) below is satisfied, where Δx is the distance from the cleaner 1 (the fan 15 or the ribs 363) as a noise source, ΔdB is the value of noise from the cleaner 1, Mc is the characteristic Mach number, Mm is the Mach number at the distal end of the blade 154, and R is the duct radius.

$$\Delta dB/\Delta x=-8.69\times|m|\times(Mc^2-Mm^2)^{1/2}/R \tag{3}$$

In formula (3), the absolute value |m| being smaller indicates the noise value ΔdB being less likely to attenuate at a longer distance Δx from the cleaner 1. In other words, the absolute value |m| being smaller indicates a smaller attenuation rate of noise from the cleaner 1, indicating that the noise reaches a longer distance from the cleaner 1.

In the embodiment, the number Z of blades 154, the number V of ribs 363, and the rotational speed N of the fan 15 are determined to cause the frequency $f_{NZ}$ to be 20,000 Hz or higher for the integer m being −1 to +1 inclusive ($|m|\leq 1$). The frequency $f_{NZ}$ of noise may be set to 20,000 Hz or higher to reduce noise audible to humans under the conditions in which the cleaner 1 produces noise reaching far with the noise value ΔdB that is less likely to attenuate.

The characteristic Mach number Mc is determined using the integer m and a hub ratio σ. The hub ratio σ is the ratio of the hub diameter to the duct diameter, or in other words, (hub diameter)/(duct diameter). For an open space with no duct used, the hub ratio σ is zero.

FIG. 19 is an example table showing the characteristic Mach number Mc in the embodiment. As shown in FIG. 19, the characteristic Mach number Mc is determined using the integer m and the hub ratio σ.

The Mach number Mm at the distal end of the blade 154 is expressed by formula (4) below.

$$Mm=(\pi\times D\times N)/(60\times a_0) \tag{4}$$

where D is the diameter (m) of the blade 154 and $a_0$ is the sound speed.

FIG. 20 is a table describing a method for calculating the frequency $f_{NZ}$ of noise in the embodiment.

In the example shown in FIG. 20, the number Z of blades 154, the number V of ribs 363, the rotational speed N of the fan 15, the integer k, and the order n are first set to selected values. The integer m is then calculated using formula (2). The frequency $f_{NZ}$ is then calculated using formula (1).

FIG. 20 shows the relationships between the integer k, the integer m, and the frequency $f_{NZ}$ for the settings with the number Z being 3, the number V being 5, the rotational speed N being 600 rpm, the integer k being each value shown in FIG. 20, and the order n being 1.

Setting the integer k to a value shown in FIG. 20 yields the integer m using formula (2). For example, setting the integer k to −5 yields the integer $m=1\times3+(-5)\times5$, which is −22. Setting the integer k to −4 yields the integer $m=1\times3+(-4)\times5$, which is −17.

The integer k and the integer m being determined yield the frequency $f_{NZ}$ using formula (1). For example, the integer k being −5 and the integer m being −22 yield the frequency $f_{NZ}=(-22-(-5)\times5)\times600/60$, which is 30 Hz. The integer k being −4 and the integer m being −17 yield the frequency $f_{NZ}=(-17-(-4)\times5)\times600/60$, which is 30 Hz.

As shown in FIG. 20, the number Z, the number V, the rotational speed N, and the order n may be set to selected values to yield the constant frequency $f_{NZ}$ (30 Hz) independently of the varying integers k and m.

In the example shown in FIG. 20, the absolute value |m| is minimum for the integer m being −2. This indicates that the noise value ΔdB is less likely to attenuate at a longer distance Δx from the cleaner 1 for the integer m being −2 in the example shown in FIG. 20.

In the embodiment, the number Z, the number V, the rotational speed N, the integer k, and the order n are determined to cause the frequency $f_{NZ}$ to be 20,000 Hz or higher for the integer m being −1 to +1 inclusive ($|m|\leq1$). Thus, the frequency $f_{NZ}$ of noise may be set to 20,000 Hz or higher to reduce noise audible to humans under the conditions with the noise value ΔdB that is less likely to attenuate.

In the embodiment, the number Z is selected from between 2 and 20 inclusive. The number V is selected from between 1 and 50 inclusive. The rotational speed N is selected from between 1,000 and 40,000 inclusive. The integer k is selected from between −10 and +10 inclusive. The order n is selected from between 1 and 10 inclusive. The number Z, the number V, the rotational speed N, the integer k, and the order n are selected from their respective limited numerical ranges. This reduces the load for calculating the frequency $f_{NZ}$.

Method for Setting Suction Unit

The method for setting the suction unit 3 will now be described. Setting the suction unit 3 includes determining the number Z of blades 154, the number V of ribs 363, and the rotational speed N of the fan 15 indicating the revolutions per minute to cause the frequency $f_{NZ}$ to be 20,000 Hz or higher. These settings of the suction unit 3 are performed with a computer system.

Figure 21:
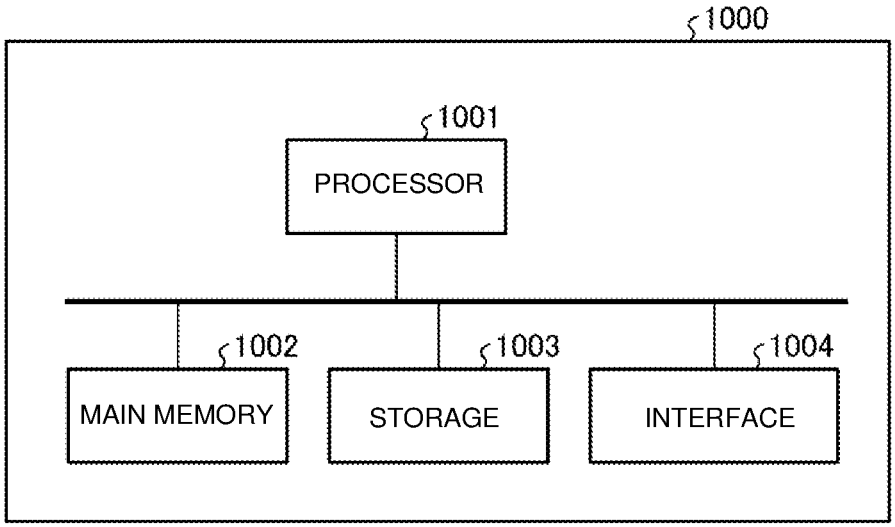
FIG. 21 is a block diagram of a computer system in the embodiment.

FIG. 21 is a block diagram of a computer system 1000 in the embodiment. The computer system 1000 includes a processor 1001, a main memory 1002, a storage 1003, and an interface 1004 including an input-output circuit. The processor 1001 may be a CPU. The main memory 1002 may be a nonvolatile memory such as a ROM and a volatile memory such as a RAM. The processor 1001 reads a computer program from the storage 1003, loads the computer program in the main memory 1002, and sets the suction unit 3 in accordance with the loaded computer program. The computer program may be distributed to the computer system 1000 through a network.

For setting the suction unit 3 to produce noise with the frequency $f_{NZ}$ of 20,000 Hz or higher, the computer system 1000 first determines, as selected values, the number Z, the number V, the integer k, and the order n. The computer system 1000 then calculates the absolute value |m| of the integer m using formula (2). The computer system 1000 determines the number Z, the number V, the integer k, and the order n to cause the integer m to be −1 to +1 inclusive, or in other words, $|m|\leq1$.

After determining the integer m satisfying $|m|\leq1$, the number Z, the number V, the integer k, and the order n, the computer system 1000 determines the rotational speed N to cause the frequency $f_{NZ}$ to be 20,000 Hz or higher using the integer m satisfying $|m|\leq1$, the number V, and the integer k using formula (1).

Figure 22:
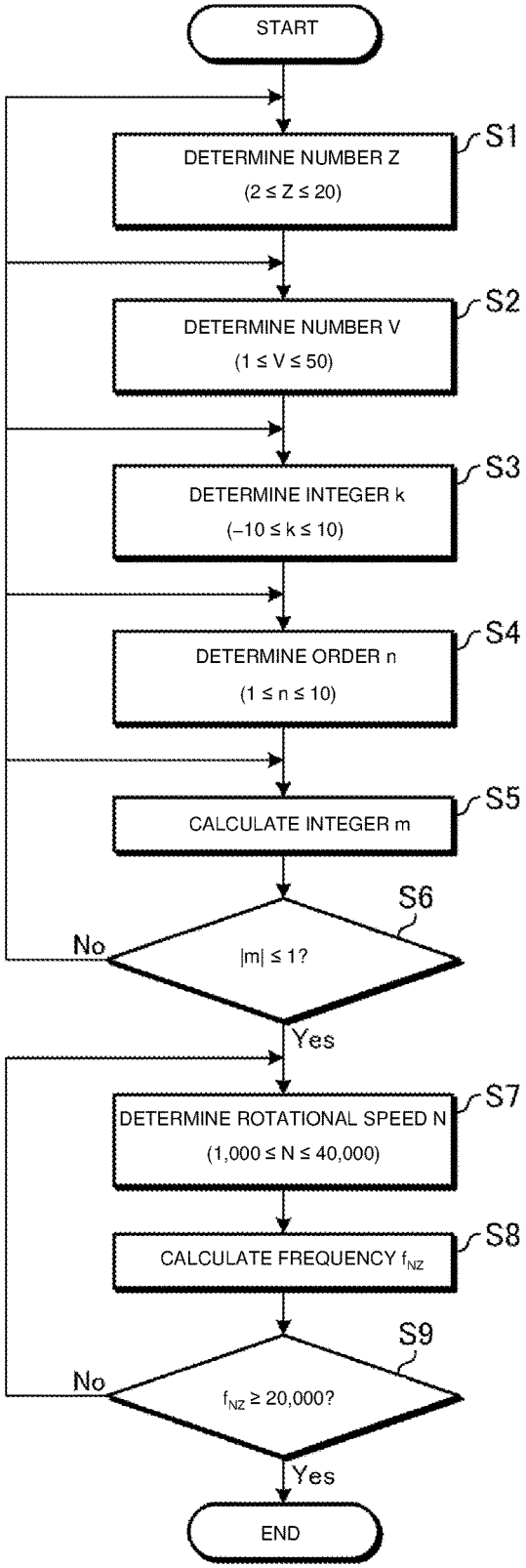
FIG. 22 is a flowchart showing a method for setting the suction unit in the embodiment.

FIG. 22 is a flowchart showing the method for setting the suction unit 3 in the embodiment.

The computer system 1000 determines the number Z of blades 154. The number Z is a natural number. The computer system 1000 selects the number Z from between 2 and 20 inclusive (step S1).

The computer system 1000 determines the number V of ribs 363. The number V is a natural number. The computer system 1000 selects the number V from between 1 and 50 inclusive (step S2).

The computer system 1000 determines the integer k. The computer system 1000 selects the integer k from between −10 and 10 inclusive (step S3).

The computer system 1000 determines the order n. The order n is a natural number. The computer system 1000 selects the order n from between 1 and 10 inclusive (step S4).

Steps S1 to S4 may be performed in any order. At least two of steps S1 to S4 may be performed in parallel.

The computer system 1000 calculates the integer m using the number Z determined in step S1, the number V determined in step S2, the integer k determined in step S3, and the order n determined in step S4 using formula (2). More specifically, the computer system 1000 calculates the integer m by substituting the number Z determined in step S1, the number V determined in step S2, the integer k determined in step S3, and the order n determined in step S4 into formula (2) (step S5).

The computer system 1000 determines whether the absolute value |m| of the integer m calculated in step S5 is 1 or less (step S6).

In response to the absolute value |m| not being 1 or less in step S6 (No in step S6), the computer system 1000 varies at least one of the number Z, the number V, the integer k, or the order n. The computer system 1000 varies the combination of the number Z, the number V, the integer k, and the order n until the absolute value |m| of the integer m calculated using formula (2) is 1 or less.

In response to the absolute value |m| being 1 or less in step S6 (Yes in step S6), the computer system 1000 determines the rotational speed N of the fan 15. The rotational speed N is a natural number. The computer system 1000 selects the rotational speed N from between 1,000 and 40,000 inclusive (step S7).

The computer system 1000 calculates the frequency $f_{NZ}$ using the integer m determined in step S5, the integer k determined in step S3, the number V determined in step S2, and the rotational speed N determined in step S7 using formula (1). More specifically, the computer system 1000 calculates the frequency $f_{NZ}$ by substituting the integer m determined in step S5, the integer k determined in step S3, the number V determined in step S2, and the rotational speed N determined in step S7 into formula (1) (step S8).

The computer system 1000 determines whether the frequency $f_{NZ}$ calculated in step S8 is 20,000 Hz or higher (step S9).

In response to the frequency $f_{NZ}$ not being 20,000 Hz or higher in step S9 (No in step S9), the computer system 1000 varies the rotational speed N. The computer system 1000 varies the rotational speed N until the frequency $f_{NZ}$ calculated using formula (1) is 20,000 Hz or higher while using the integer m determined in step S5, the integer k determined in step S3, and the number V determined in step S2.

In response to the frequency $f_{NZ}$ being 20,000 Hz or higher in step S9 (Yes in step S9), the computer system 1000 ends the settings of the suction unit 3.

In the embodiment described above, the number Z, the number V, the integer k, and the order n are determined using formula (2) to cause the integer m to be −1 to +1 inclusive (steps S1 to S6). The rotational speed N is then determined using formula (1) to cause the frequency $f_{NZ}$ to be 20,000 Hz or higher (step S7 to step S9).

For example, the number Z is determined to be 11, the number V is determined to be 14, the integer k is determined to be −4, and the order n is determined to be 5. These numbers are substituted into formula (2) to cause the integer m to be −1. The rotational speed N is determined to be 22,000 rpm. These numbers are substituted into formula (1) to cause the frequency $f_{NZ}$ to be about 20,167 Hz. The rotational speed N may be determined to be 40,000 rpm to cause the frequency $f_{NZ}$ to be about 36,666 Hz. Thus, the rotational speed N may be set to 22,000 to 40,000 inclusive to cause the frequency $f_{NZ}$ to be 20,000 Hz or higher when the number Z is 11, the number V is 14, the integer k is −4, and the order n is 5.

In the embodiment described above, the fan 15 rotates behind the ribs 363. In this structure, the number Z of blades 154, the number V of ribs 363, and the rotational speed N of the fan 15 indicating the revolutions per minute are determined to cause noise from the rotating fan 15 to have the frequency $f_{NZ}$ of 20,000 Hz or higher. The range of human hearing is specified to be higher than or equal to 15 Hz and lower than 20,000 Hz. Humans cannot hear noise from the rotating fan 15 having the frequency $f_{NZ}$ of 20,000 Hz or higher. In other words, setting the frequency $f_{NZ}$ of noise to 20,000 Hz or higher can reduce noise audible to humans. This reduces noise from the cleaner 1.

The frequency $f_{NZ}$ is calculated using formula (1). The integer m is calculated using formula (2). The integer m ($=n\times Z+k\times V$) is included in formula (3). The integer m is a value associated with the attenuation rate of the noise value ΔdB with respect to the distance Δx from the fan 15 or the ribs 363. The integer m having a smaller absolute value |m| indicates a smaller attenuation rate of noise from the cleaner 1, indicating that the noise reaches farther. In other words, the absolute value |m| being smaller indicates the cleaner 1 having the noise value ΔdB that is less likely to attenuate. For the absolute value |m| being 1 or less, the cleaner 1 has the noise value ΔdB that is less likely to attenuate. The number Z of blades 154, the number V of ribs 363, and the rotational speed N of the fan 15 are determined to cause the frequency $f_{NZ}$ to be 20,000 Hz or higher for the integer m being −1 to +1 inclusive ($|m|\leq 1$). The frequency $f_{NZ}$ of noise may be set to 20,000 Hz or higher to reduce noise from the cleaner 1 audible to humans under the conditions in which the cleaner 1 produces noise with the noise value ΔdB that is less likely to attenuate.

As described with reference to steps S1 to S6 in FIG. 22, the number Z, the number V, the integer k, and the order n are determined using formula (2) to cause the integer m to be −1 to +1 inclusive.

As described with reference to steps S7 to S9 in FIG. 22, the rotational speed N is determined using formula (1) to cause the frequency $f_{NZ}$ to be 20,000 Hz or higher after the number Z, the number V, the integer k, and the order n are determined to cause the integer m to be −1 to +1 inclusive.

In step S1, the number Z is selected from natural numbers between 2 and 20 inclusive. In step S2, the number V is selected from natural numbers between 1 and 50 inclusive. In step S3, the integer k is selected from between −10 and 10 inclusive. In step S4, the order n is selected from natural numbers between 1 and 10 inclusive. In step S7, the rotational speed N is selected from natural numbers between 1,000 and 40,000 inclusive. The number Z, the number V, the integer k, the order n, and the rotational speed N are selected from their respective limited numerical ranges. This reduces the load for calculating the frequency $f_{NZ}$ with the computer system 1000.

In the embodiment, the number Z is 11, the number V is 14, the integer k is −4, and the order n is 5. The rotational speed N is set to 22,000 to 40,000 inclusive.

The inner ring 361 is at the center of the inlet 35. The first inlet 351 is thus formed inside the inner ring 361. The ribs 363 have radially inner ends connected to the inner ring 361. The ribs 363 are thus connected together with the inner ring 361. Each second inlet 352 is formed between adjacent ribs 363.

The outer ring 362 surrounds the inner ring 361. The outer ring 362 defines the profile of the inlet 35 (second inlets 352). The ribs 363 have radially outer ends connected to the outer ring 362. The ribs 363 are thus supported by each of the inner ring 361 and the outer ring 362.

The outer ring 362 includes the first portions 362A each having the first dimension in the axial direction, and the second portions 362B each having the second dimension larger than the first dimension. The first portions 362A are located at intervals in the circumferential direction. Each second portion 362B is between adjacent first portions 362A in the circumferential direction. The outer ring 362 has steps at the front end. This structure allows smooth flow of air sucked into the inlet 35, thus reducing noise.

The ribs 363 include the first ribs 363A connected to the first portions 362A and the second ribs 363B connected to the second portions 362B. The first ribs 363A have the front ends at least partly located rearward from the front ends of the second portions 362B. This structure allows smooth flow of air sucked into the inlet 35, thus reducing noise.

Other Embodiments

The second cover 32 and the second elastic member 62 may be integrally molded in the above embodiments.

The suction unit 3 is included in a handheld cleaner in the above embodiments. In some embodiments, the suction unit 3 may be included in a wheeled cleaner.

REFERENCE SIGNS LIST

1 cleaner
2 housing
3 suction unit
4 filter holder
5 sound absorber
6 battery mount

7 controller
8 interface unit
9 handle
10 suction port
11 exhaust port
12 motor assembly
13 cover
14 motor
15 fan
16 motor case
17 control board
18 filter
19 battery pack
21 front housing
22 rear housing
22L left housing
22R right housing
22S screw
23 cylinder
24 fan cover
25 support
26 leg
27 inflow port
28 outflow port
31 first cover
32 second cover
33 cylinder
34 front plate
35 inlet
36 flow straightener
37 protrusion
38 protrusion
39 screw opening
41 cylinder
42 rear plate
43 opening
44 screw boss
45 screw hole
46 pin
47 support
48 protrusion
49 protrusion
51 first surface
52 second surface
53 peripheral surface
54 air passage
55 support slit
60 elastic member
61 first elastic member
62 second elastic member
63 first connector
64 second connector
65 blocker
66 pipe
67 support hole
70 guide
71 first guide
72 second guide
73 third guide
74 flow path
75 discharge port
81 drive button
82 mode switch button
83 indicator
90 screw
141 rotor shaft
151 inlet
152 front plate
153 rear plate
154 blade
155 outlet
211 opening
212 connection pipe
213 inner surface
214 recess
214A first face
214B second face
214C third face
214D fourth face
215 lock
216 opening
217 hook
221 support
221A peripheral wall
221B rib
222 support
222A front support
222B upper support
222C lower support
223 support
224 controller support
225 ring
341 ring
342 ring
343 rib
344 rib
351 first inlet
352 second inlet
361 inner ring
362 outer ring
362A first portion
362B second portion
363 rib
363A first rib
363B second rib
1000 computer system
1001 processor
1002 main memory
1003 storage
1004 interface
AX rotation axis

What is claimed is:

1. A cleaner, comprising:

a motor;

a fan including a number Z of blades, the fan being rotatable at a rotational speed N about a rotation axis by the motor, the rotational speed N indicating revolutions per minute;

a cover having an inlet located frontward from the fan;

a number V of ribs located in the inlet, the ribs extending in a radial direction from the rotation axis and arranged in a circumferential direction about the rotation axis;

an inner ring at a center of the inlet; and an outer ring surrounding the inner ring and defining a profile of the inlet, wherein:

the ribs have radially inner ends connected to the inner ring, the ribs have radially outer ends connected to the outer ring, the outer ring includes a plurality of first portions located at intervals in a circumferential direction and each having a first dimension in an axial direction, and a plurality of second portions each located between adjacent first portions of the plurality of first portions, and the plurality of second portions each have a second dimension larger than the first dimension, the ribs include a plurality of first ribs connected to the plurality of first portions, and a plurality of second ribs connected to the plurality of second portions, and the plurality of first ribs have front ends at least partly located rearward from front ends of the plurality of second ribs.

2. The cleaner according to claim 1, wherein:

the fan is rotatable to produce noise having a frequency $f_{NZ}$ of 20,000 Hz or higher, and $f_{NZ}=(m-k\times V)\times N/60$ and $m=n\times Z+k\times V$, where n is an order, m is an integer, and k is an integer, and the integer m is a value associated with an attenuation rate of the noise with respect to a distance from the fan or the ribs that satisfies a following equation:

$$\Delta dB/\Delta x=-8.69\times|m|\times(Mc^2-Mm^2)^{1/2}/R$$

the integer m being −1 to +1 inclusive, Δx is a distance from the cleaner, ΔdB is a value of noise from the cleaner, Mc is a characteristic Mach number, Mm is a Mach number at a distal end of the blade, and R is a duct radius.

3. The cleaner according to claim 2, wherein the number Z, the number V, the integer k, and the order n are determined to cause the integer m to be −1 to +1 inclusive.

4. The cleaner according to claim 3, wherein after the number Z, the number V, the integer k, and the order n are determined to cause the integer m to be −1 to +1 inclusive, the rotational speed N is determined to cause the frequency $f_{NZ}$ to be 20,000 Hz or higher.

5. The cleaner according to claim 2, wherein the number Z is 2 to 20 inclusive, the number V is 1 to 50 inclusive, the rotational speed N is 1,000 to 40,000 inclusive, the integer k is −10 to 10 inclusive, and the order n is 1 to 10 inclusive.

6. The cleaner according to claim 5, wherein the number Z is 11, the number V is 14, the rotational speed N is 22,000 to 40,000 inclusive, the integer k is −4, and the order n is 5.

* * * * *